US010569311B2

(12) United States Patent
Oberto et al.

(10) Patent No.: US 10,569,311 B2
(45) Date of Patent: Feb. 25, 2020

(54) PLUMBING DEVICE AND ASSOCIATED SYSTEMS AND METHODS

(71) Applicant: Moja Industries, Levittown, PA (US)

(72) Inventors: John J. Oberto, Levittown, PA (US); Andrew Mirabelli, Hamilton, NJ (US)

(73) Assignee: Moja Industries, Levittown, PA (US)

( * ) Notice: Subject to any disclaimer, the term of this patent is extended or adjusted under 35 U.S.C. 154(b) by 720 days.

(21) Appl. No.: 15/145,086

(22) Filed: May 3, 2016

(65) Prior Publication Data

US 2016/0325320 A1 Nov. 10, 2016

Related U.S. Application Data

(60) Provisional application No. 62/158,745, filed on May 8, 2015.

(51) Int. Cl.

| | |
|---|---|
| ***B08B 9/04*** | (2006.01) |
| ***E03F 9/00*** | (2006.01) |
| ***E03D 9/00*** | (2006.01) |
| ***B08B 9/045*** | (2006.01) |
| ***E03C 1/302*** | (2006.01) |

(52) U.S. Cl.

CPC ..... *B08B 9/04* (2013.01); *B08B 9/045* (2013.01); *E03C 1/302* (2013.01); *E03D 9/00* (2013.01); *E03F 9/005* (2013.01)

(58) Field of Classification Search

CPC .. E03C 1/30; E03C 1/302; B08B 9/04; B25G 3/00; B25G 3/02; B25G 3/12; F16B 7/20

USPC ..... 15/104.31, 104.33

See application file for complete search history.

(56) References Cited

U.S. PATENT DOCUMENTS

| | | | |
|---|---|---|---|
| 1,225,739 | A | 5/1917 | Alder |
| 1,787,112 | A | 12/1930 | King |
| 1,817,015 | A | 8/1931 | Miller |
| 1,844,433 | A | 2/1932 | Markowitz |
| 1,910,768 | A | 5/1933 | Hotchkiss, Jr. |
| 1,959,490 | A | 5/1934 | Mistelski |
| 1,982,402 | A | 11/1934 | Shade |
| 2,044,848 | A | 6/1936 | Hermanson |
| 2,600,707 | A | 6/1952 | Turnbaugh |
| 2,661,489 | A | 12/1953 | Rudolph |
| 2,961,675 | A | 11/1960 | Stickney |

(Continued)

FOREIGN PATENT DOCUMENTS

| | | | |
|---|---|---|---|
| GB | 365261 | A | 1/1932 |
| GB | 2096301 | A | 11/1982 |

OTHER PUBLICATIONS

Ridgid® KJ-1750 Electric Jetter With Dual Pulse (available at https://www.ridgid.com/us/en/kj1750-water-jetter).

(Continued)

*Primary Examiner* — Orlando E Aviles
*Assistant Examiner* — Aaron R McConnell
(74) *Attorney, Agent, or Firm* — McCarter & English, LLP

(57) ABSTRACT

Exemplary embodiments are directed to plumbing devices that include an elongated body and an adaptor. The elongated body can define a proximal end and a distal end. The adaptor can be disposed at or mounted to the proximal end of the elongated body. The adaptor can include a cavity. The cavity of the adaptor can be configured and dimensioned to receive therein at least a portion of plumbing equipment. Exemplary embodiments are also directed to methods of plumbing repair and plumbing device systems.

19 Claims, 12 Drawing Sheets

(56) References Cited

U.S. PATENT DOCUMENTS

| | | | | | |
|---|---|---|---|---|---|
| 3,121,244 | A | | 2/1964 | Hunt | |
| 3,206,782 | A | | 9/1965 | Larsen | |
| 3,224,024 | A | | 12/1965 | Hunt | |
| 3,449,782 | A | | 6/1969 | Hunt | |
| 4,317,247 | A | | 3/1982 | Levine | |
| 4,361,924 | A | | 12/1982 | Irwin | |
| 4,364,140 | A | * | 12/1982 | Irwin | E03F 9/005 15/104.33 |
| 4,552,338 | A | | 11/1985 | Lindgren | |
| 4,644,603 | A | | 2/1987 | Meyer | |
| 4,706,321 | A | | 11/1987 | Kaye | |
| 4,819,292 | A | * | 4/1989 | Kerr | E03F 9/005 15/104.33 |
| 5,000,750 | A | * | 3/1991 | LeVeen | A61B 17/22 606/1 |
| 5,018,234 | A | | 5/1991 | Meyer et al. | |
| 5,056,177 | A | | 10/1991 | Nast | |
| 5,230,116 | A | | 7/1993 | Rodriguez | |
| 5,265,301 | A | | 11/1993 | Irwin | |
| 5,301,382 | A | | 4/1994 | Stout | |
| 5,388,966 | A | | 2/1995 | Bley | |
| 5,414,888 | A | | 5/1995 | Irwin | |
| 5,987,684 | A | | 11/1999 | Evans | |
| 6,276,018 | B1 | | 8/2001 | Leiman et al. | |
| 6,421,871 | B1 | | 7/2002 | Peach et al. | |
| 7,194,773 | B2 | | 3/2007 | Bixby | |
| 2007/0089254 | A1 | | 4/2007 | Alaine | |
| 2008/0244816 | A1 | * | 10/2008 | Babb | B08B 9/045 4/255.01 |
| 2010/0313351 | A1 | | 12/2010 | Wooten | |
| 2016/0186792 | A1 | * | 6/2016 | Valencia | F16B 7/0406 403/349 |

OTHER PUBLICATIONS

Ridgid® K-50 Drain Cleaner Sectional Machine (available at https://www.ridgid.com/us/en/k50-sectional-machine).

Ridgid® K-45 Sink Machine Drain Gun With Autofeed, for ¾-2-½inch drain lines (available at https://www.ridgid.com/us/en/k45af-sink-machine).

Ridgid® K-400 Drum Machine With C-31 Integral Wound Cable, Model 26993 (available at https://www.ridgid.com/us/en/k400-drum-machine).

Westward Drain Cleaning Gun (available at http://www.grainger.com/product/WESTWARD-Drain-Cleaning-Gun-Kit-22XP37).

Westward Drain Cleaning Machine (available at http://www.grainger.com/product/WESTWARD-Drain-Cleaning-Machine-22XP38).

Westward Drain Cleaning Gun (available at http://www.grainger.com/product/WESTWARD-Drain-Cleaning-Gun-22XP36).

General Pipe Cleaner Super-Vee, Model 10882 (available at https://www.drainbrain.com/pro/1supervee.html).

General Drain Rooter (available at http://www.drainbrain.com/pro/4drainrooter.html).

Extended European Search Report for European Application No. 16168253.9 dated Oct. 7, 2016.

* cited by examiner

PLUMBING DEVICE AND ASSOCIATED SYSTEMS AND METHODS

CROSS-REFERENCE TO RELATED APPLICATIONS

The present application claims the priority benefit of U.S. Provisional Application Ser. No. 62/158,745, filed May 8, 2015, which is hereby incorporated by reference in its entirety.

FIELD OF THE INVENTION

The present disclosure relates to plumbing devices and associated systems and methods and, in particular, to plumbing devices including a universal adaptor for attachment of plumbing equipment to the plumbing devices.

BACKGROUND OF THE INVENTION

A variety of plumbing equipment is used in the industry for cleaning clogged piping associated with plumbing fixtures, such as sanitary lines associated with toilets. For example, some traditional handheld augers include an elongated body, a six foot long cable extending from the elongated body, and a hand crank for rotating the cable. The length of the cable limits use of the traditional handheld auger to clearing clogs occurring immediately downstream of a plumbing fixture and cannot be used to clear clogs in commercial settings where piping extends beyond six feet. In particular, some commercial settings include multiple plumbing fixtures connected to a sanitary line with the clog occurring twenty or more feet downstream of the plumbing fixtures.

As a further example, some traditional handheld augers include an extendable cable wrapped in a spool and a handle that can be cranked by the user or an electric drill to extend and retract the cable from the auger and into the piping. The cable can be inserted into the toilet bowl, extended through the toilet trap, and further extended into the piping until the coil or bulk at the distal end of the cable reaches debris (e.g., newspapers, waste, or the like) causing the clogged piping. The cable can be retracted while the coil or bulk of the cable captures and pulls out the debris in the piping. The process may be repeated until the debris has been cleared from the piping. Inserting and moving the cable within the toilet bowl can displace the water in the toilet bowl, creating spillage onto the surrounding floor.

During use of the traditional auger, the cable can scar or damage portions of the porcelain of the toilet bowl. In some configurations, extending the cable through the toilet trap and into the piping may require a substantially ninety degree turn of the cable from the toilet trap and into the piping that can result in tangling or twisting of the cable within the piping, thereby preventing stable extension of the cable in the direction of the clog. The unstable extension of the cable through a long length of piping can prevent the user from reaching the clog or may damage the cable.

Although large plumbing machines exist in the industry, the size and weight of the machines generally requires two operators and increases the time and labor costs associated with clearing a clog. Some large plumbing machines in the industry also require pumping out the water in the plumbing fixture and removing a cleanout plug from the plumbing fixture and/or removing the plumbing fixture from the wall prior to use. An industrial shop vacuum can also be incorporated into the process to prevent water and sewage flooding during the cleaning operation. The use of large plumbing machines can therefore result in further increases in time and labor costs.

Thus, a need exists for plumbing devices that can accommodate a variety of plumbing equipment for safe and stable extension of the cable through the toilet trap and piping. These and other needs are addressed by the plumbing devices and associated systems and methods of the present disclosure.

SUMMARY OF THE INVENTION

In accordance with embodiments of the present disclosure, exemplary plumbing devices are provided that include an elongated body and an adaptor. The elongated body can define a proximal end and a distal end. The adaptor can be disposed at or mounted to the proximal end of the elongated body. The adaptor can include a cavity formed therein. The cavity of the adaptor can be configured and dimensioned to receive therein at least a portion of plumbing equipment, e.g., a barrel of an auger, or the like.

The elongated body can include a hollow tube including a linear section and a curved section. The curved section can be disposed at the distal end of the elongated tube. The elongated body can include a first protective feature disposed around a portion of the linear section. The elongated body can include a second protective feature disposed around the curved section. The second protective feature can cover the entire surface area of the curved section. The elongated body can include a passage therein. The adaptor can include a bore formed therein. The passage and the bore can be in communication and alignment relative to each other.

The adaptor can include a locking mechanism. The locking mechanism can detachably secure the portion of plumbing equipment within the cavity of the adaptor. In some embodiments, the locking mechanism can include a threaded bore formed in a bottom surface of the adaptor and extending into the cavity. The locking mechanism can include a threaded fastening member configured to mate with the threaded bore and pass into the cavity to impart a force on the portion of plumbing equipment. The force imparted on the portion of plumbing equipment can prevent removal of the portion of plumbing equipment from the cavity. In some embodiments, the locking mechanism can include or function substantially similar to a set screw mechanism.

In some embodiments, the adaptor can include a first section including a cylindrical body, and a second section including cylindrical bottom, cylindrical sides and a cut-out forming a flat top surface. The adaptor can include an opening formed between side walls of the flat top surface. The opening can extend into the cavity.

In some embodiments, the plumbing devices can include a supporting cradle. The supporting cradle can include a curved central section and two side sections extending from the curved central section. The curved central section can define a curved bottom surface of the supporting cradle. The curved central section and the two side sections can form a cavity therebetween configured and dimensioned to receive the adaptor. The curved central section and the two side sections can form a cavity therebetween configured and dimensioned to receive and provide support for a second portion of the plumbing equipment.

The curved central section can include a plurality of holes formed therein. The holes can be configured and dimensioned to receive therethrough a threaded fastening member mating with a threaded bore formed in a bottom surface of the adaptor. The threaded fastening member can secure the supporting cradle to the adaptor. The supporting cradle can be configured and dimensioned to support the weight of the plumbing equipment without support of the plumbing equipment from a user, e.g., in a hands-free manner.

In some embodiments, the second section can include two radially disposed slots formed on inner walls of the second section. Each of the slots can be configured and dimensioned to receive and interlock with complementary protrusions of plumbing equipment. Each of the slots can include an elongated portion extending from a proximal end of the adaptor and a perpendicular groove extending from a distal end of the elongated portion.

In accordance with embodiments of the present disclosure, exemplary methods of plumbing repair are provided. The methods include providing a plumbing device as described herein. The methods include positioning the distal end of the elongated body within a passage of a plumbing fixture, e.g., a toilet bowl. The methods include securing the portion of plumbing equipment within the cavity of the adaptor.

The methods can include detachably securing the portion of plumbing equipment within the cavity of the adaptor with a locking mechanism. The locking mechanism can include a threaded fastening member passing through a threaded bore formed in a bottom surface of the adaptor an imparting a force on the portion of plumbing equipment, thereby clamping the portion of plumbing equipment to an inner top surface of the cavity. In some embodiments, the methods can include securing a supporting cradle to the adaptor and supporting the plumbing equipment with the supporting cradle without support of the plumbing equipment from a user. In some embodiments, the methods can include interlocking protrusions extending from a distal end of the plumbing equipment with slots formed in the adaptor to detachably secure the plumbing equipment to the adaptor.

In accordance with embodiments of the present disclosure, exemplary plumbing device systems are provided that include a plumbing device as described herein and plumbing equipment. The cavity of the adaptor of the plumbing device can be configured and dimensioned to receive therein at least a portion of the plumbing equipment. In some embodiments, the adaptor can include a first section and a second section, the second section including two radially disposed slots formed on inner walls of the second section. The plumbing equipment can include a barrel including two radially disposed protrusions complementary to the two radially disposed slots of the adaptor. Each of the two radially disposed slots can be configured and dimensioned to receive and interlock with the two radially disposed protrusions of the plumbing equipment to detachably secure the plumbing equipment to the adaptor without a supporting cradle.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed plumbing devices and associated systems and methods, reference is made to the accompanying figures, wherein.

DETAILED DESCRIPTION OF THE INVENTION

Figure 1:
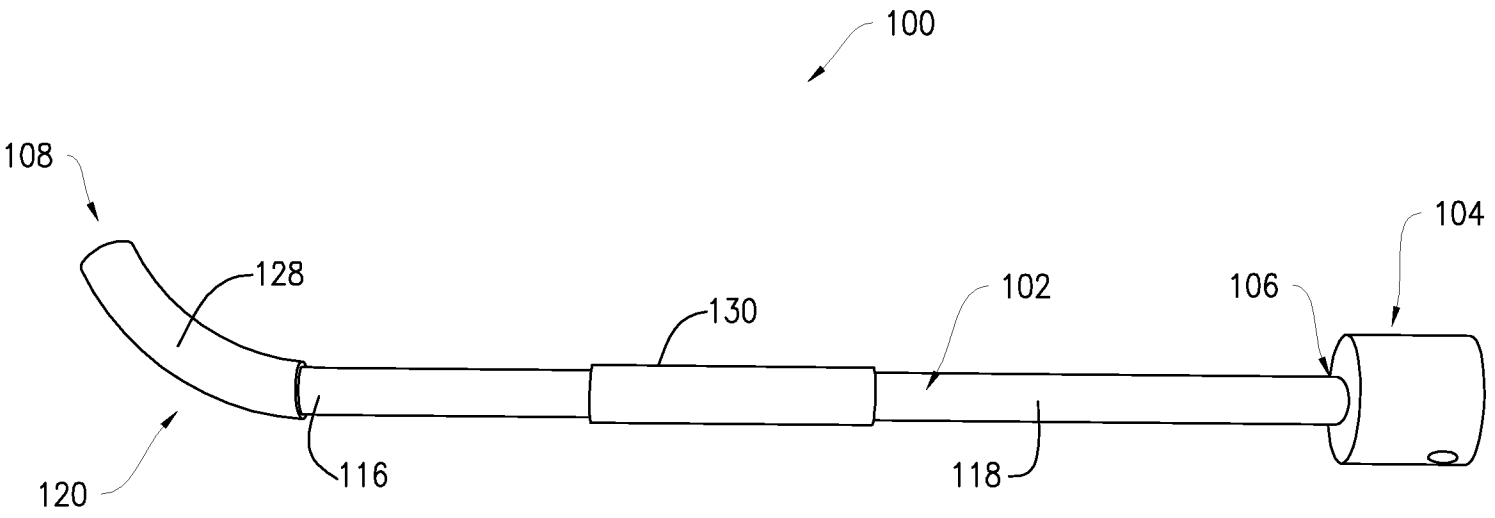
FIG. 1 is side view of an exemplary plumbing device including an elongated body and an adaptor according to the present disclosure.

In accordance with embodiments of the present disclosure, exemplary plumbing devices are provided that include a hollow elongated body and an adaptor. The adaptor can be configured to cooperate with and detachably receive a portion of plumbing equipment such that the plumbing equipment is permanently or temporarily secured to the plumbing device via the adaptor. The plumbing devices accommodate safe and stable extension of cable associated with the plumbing equipment through the plumbing fixture piping, such as a toilet trap and piping extending into a sanitary line. In particular, the hollow elongated body can be configured to allow passage of the cable therethrough and into the plumbing fixture piping in a directed and stable manner. The plumbing devices therefore provide an ability to use standard plumbing equipment in a commercial setting in an efficient manner. Although discussed herein with respect to clearing a clog in toilet piping, it should be understood that the exemplary plumbing devices can be used to clear clogs in other types of piping. In some embodiments, the plumbing devices include a self-supporting cradle that provides a supporting surface on which the plumbing equipment can be rested in a hands-free manner.

The plumbing devices discussed herein can be customized or adapted to act as a supplement for a variety of plumbing equipment used in the industry (such as augers, auto-feed drain cleaning guns, or the like) that include an extendable cable for clearing clogs in piping. In particular, the adaptor of the plumbing device is capable of pairing with a variety of plumbing equipment that provide an extendable cable. Plumbing equipment that can be used with the plumbing device is generally shaped in a universal manner and defines a structure that can correspond to the structure of the exemplary adaptors discussed herein. For example, the plumbing equipment can include a RIDGID® KJ-1750 Electric Jetter With Dual Pulse (see, e.g., https://www.ridgid.com/us/en/kj1750-water-jetter), a RIDGID® K-50 Drain Cleaner Sectional Machine (see, e.g., https://www.ridgid.com/us/en/k50-sectional-machine), a RIDGID® K-45 Sink Machine Drain Gun With Autofeed, for ¾-2½ inch drain lines (see, e.g., https://www.ridgid.com/us/en/k45af-sink-machine), a RIDGID® K-400 Drum Machine (see, e.g., https://www.ridgid.com/us/en/k400-drum-machine), a RIDGID® K-400 Drain Cleaner With C-31 Integral Wound Cable, Model 26993 (see, e.g., https://www.ridgid.com/us/en/k400-drum-machine), a Westward Drain Cleaning Gun (see, e.g., http://www.grainger.com/product/WESTWARD-Drain-Cleaning-Gun-Kit-22XP37), a Westward Drain Cleaning Machine (see, e.g., http://www.grainger.com/product/WESTWARD-Drain-Cleaning-Machine-22XP38), a Westward Drain Cleaning Gun (see, e.g., http://www.grainger.com/product/WESTWARD-Drain-Cleaning-Gun-22XP36), a General Pipe Cleaner Super-Vee, Model 10882 (see, e.g., http://www.drainbrain.com/pro/lsupervee.html), a General Drain Rooter (see, e.g., http://www.drainbrain.com/pro/4drainrooter.html), or the like. Although examples of plumbing equipment are provided above, it should be understood that the plumbing devices can conform to alternative plumbing equipment not discussed herein.

As noted above, the plumbing equipment used with the plumbing device includes an extendable cable for clearing clogs in sanitary piping. For example, the plumbing equipment can include a drum with an internal spool of the cable that allows the cable to be extended from the plumbing equipment. Attachment of the plumbing equipment to the adaptor of the plumbing device allows the plumbing equipment to be securely held in place relative to the elongated body during use. In addition, the elongated body of the plumbing device allows stable passage of the cable into the sanitary piping and prevents twisting of the cable in the plumbing fixture. Plumbing equipment including a long cable, e.g., thirty feet, forty feet, fifty feet, sixty feet, or the like, can therefore be used in combination with the plumbing device to clear clogs in commercial settings without the issues typically resulting from use of the plumbing equipment on its own. In particular, the plumbing device allows plumbing equipment including a long cable to be used without the necessity of removing the plumbing fixture, causing messy water puddles around the plumbing fixture, or the like. The plumbing device therefore allows for a quick, clean, more efficient and less labor-intensive clearing of a drain.

The plumbing devices discussed herein can also be used with plumbing equipment including a variety of cables. For example, the cable can be formed as a coil including a bulk at the distal end of the cable for hooking onto debris in sanitary piping. In some embodiments, the cable (or the distal end of the cable) can be a hollow core cable (e.g., ⅜ inch diameter, or the like) that provides strength and flexibility to the cable for translating the cable through the turns in sanitary piping. In some embodiments, cables or polytubes with an outer diameter of approximately ½ inch can be used. The adaptor can accommodate cable lengths of up to approximately 75 feet. In some embodiments, the adaptor can be used with a cable having a length of between approximately 35 feet and approximately 75 feet. However, it should be understood that cables of varying structures, lengths and/or diameters can be used with the plumbing device.

FIG. 1 shows a side view of an exemplary plumbing device 100. The plumbing device 100 includes an elongated body 102 and an adaptor 104, e.g., a universal adaptor. The elongated body 102 includes a proximal end 106 and a distal end 108. The proximal end 106 can include the adaptor 104 secured thereon. In some embodiments, the adaptor 104 can be welded to or over the proximal end 106 of the elongated body 102. In some embodiments, the proximal end 106 of the elongated body 102 can include threads on an outer surface complementary to threads on an inner surface of an aperture of the adaptor 104 such that the adaptor 104 can be screwed onto and fixated relative to the proximal end 106. In some embodiments, the adaptor 104 can be detachably secured to the proximal end 106 of the elongated body 102 with one or more set screws.

Figure 2:
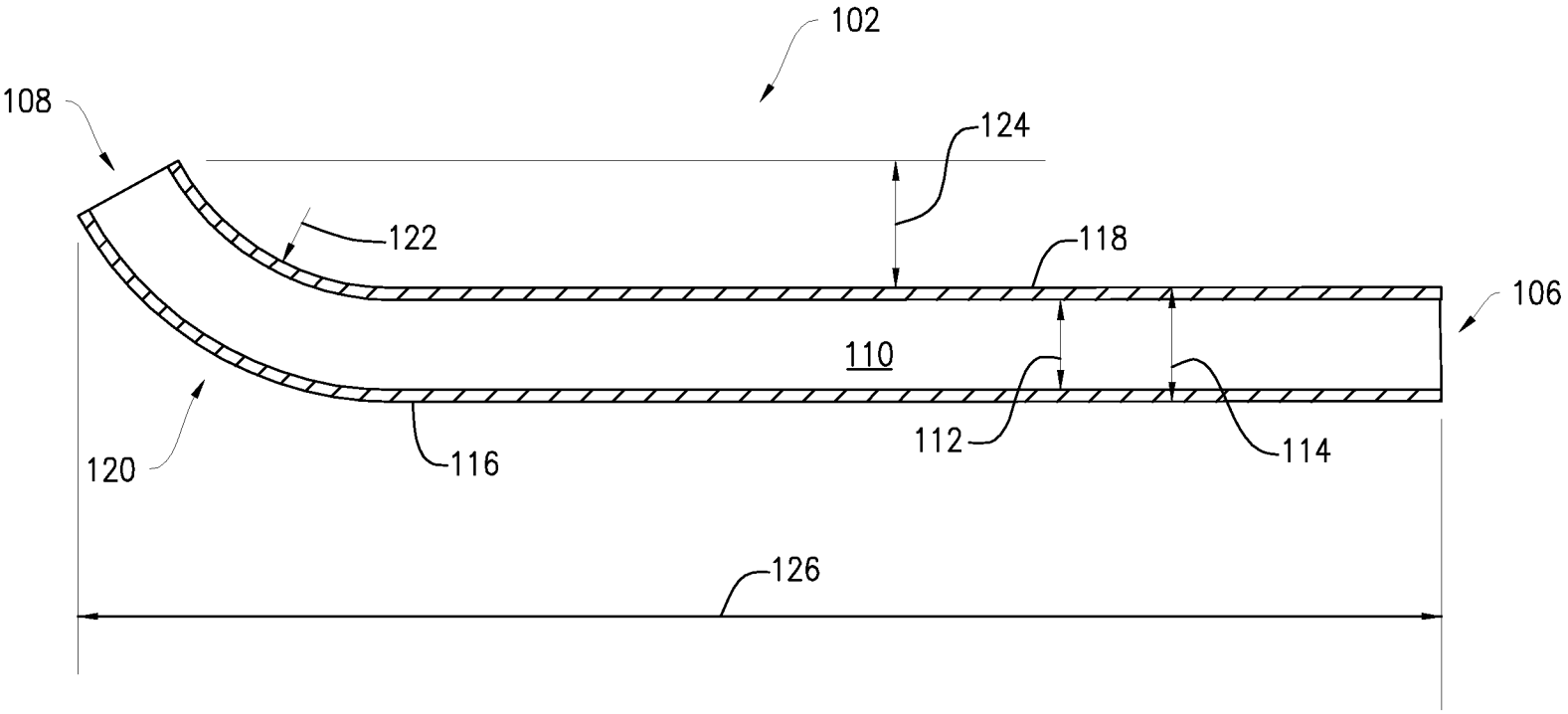
FIG. 2 is a diagrammatic, cross-sectional view of an elongated body of an exemplary plumbing device of FIG. 1.

With reference to FIGS. 1 and 2, the elongated body 102 can be fabricated or formed from a rigid and hollow tube, e.g., an aluminum tube, a steel tube, a plastic tube, or the like. In some embodiments, the elongated body 102 can be fabricated from a substantially rust-free material to prevent rust formation from continued use of the plumbing device 100 in wet environments. It should be understood that the elongated body 102 can be fabricated from a variety of metal and/or plastic materials. The elongated body 102 therefore includes an inner passage 110 therein with an inner diameter 112 and the outer surface of the elongated body 102 defines an outer diameter 114. The passage 110 forms openings at both the proximal and distal ends 106, 108 of the elongated body 102.

The hollow inner passage 110 of the elongated body 102 permits introduction of the cable associated with plumbing equipment through the inner passage 110 and into sanitary piping. In particular, the inner passage 110 can be dimensioned to allow unobstructed passage of the cable therethrough, while being dimensioned sufficiently small to provide guidance to the cable to prevent tangling or twisting of the cable within the inner passage 110. The guidance provided by the elongated body 102 results in stable extension of the plumbing equipment cable into sanitary piping.

In addition, due to the normally clockwise rotation of the cable as the cable is fed out of the plumbing equipment, the cable is naturally inclined to move in a rightward direction when entering sanitary piping connected to piping leading from the plumbing fixture. If the rightward direction in the sanitary piping is downstream and leads to the clog, the natural movement of the cable is acceptable. However, in some configurations, the rightward direction of sanitary piping can be an upstream direction and it is necessary to guide the cable in a leftward direction to move downstream and reach the clog. Typically, feeding a cable directly into the toilet bowl piping causes twisting of the cable and can result in the cable inadvertently moving into the upstream direction. The guidance provided by the elongated body 102 to the cable prevents twisting of the cable within piping leading from the plumbing fixture and into the sanitary piping. Therefore, the guidance provided by the elongated body 102 allows the cable to move into the sanitary piping in a stable manner and reduces the risk of the cable turning into an upstream direction.

The hollow inner passage 110 of the elongated body 102 also provides for a means of inserting the elongated body 102 into the toilet bowl without displacing water in the toilet bowl. For example, when a clog occurs in sanitary piping associated with the toilet bowl, the water level in the toilet bowl can rise up to the rim. Therefore, placing and moving objects within the toilet bowl can displace the water to the point of spillage of the water to the surrounding surfaces. The hollow inner passage 110 of the elongated body 102 reduces the amount of water displacement in the toilet bowl when the elongated body 102 is introduced into the toilet bowl. In addition, once the elongated body 102 has been placed into the toilet bowl, guiding the cable of the plumbing equipment through the inner passage 110 prevents water displacement that typically results from introducing and moving a cable in the toilet bowl with conventional plumbing equipment. As such, water spillage around the plumbing fixture is substantially reduced or prevented.

In some embodiments, the inner diameter 112 can be dimensioned between approximately ½ inches and approximately 1½ inches. In some embodiments, the inner diameter 112 can be dimensioned as approximately 0.825 inches. In some embodiments, the outer diameter 114 can be dimensioned between approximately ⅞ inches and approximately 1⅞ inches. In some embodiments, the outer diameter 114 can be dimensioned as approximately 0.937 inches. However, it should be understood that different dimensions could be used depending on the cable size to be passed through the passage 110. Thus, the passage 110 can be configured and dimensioned to permit passage of a variety of cable sizes associated with plumbing equipment.

The elongated body 102 can extend in a substantially linear manner from the proximal end 106 to a distal end 116 of the linear section 118. The distal end 116 of the linear section 118 can be spaced from the distal end 108 of the elongated body 102. The elongated body 102 further includes a curved section 120 (e.g., a bowl swoop curvature) extending from the distal end 116 of the linear section 118 to the distal end 108 of the elongated body 102. The curved section 120 can be configured and dimensioned to universally fit into the bottom portion of a toilet bowl, e.g., the passage leading to the toilet trap. In some embodiments, the elongated body 102 can define a linear section 118 along the entire length of the elongated body 102 and does not include the curved section 120. For example, a completely linear elongated body 102 can be used for clearing piping in sinks, drain configurations that do not conform to the curved section 120, or the like.

In some embodiments, the curved section 120 can define a radius 122 of between approximately zero inches and approximately 14 inches. In some embodiments, the curved section 120 can define an approximately ten inch radius 122. In some embodiments, the zero inch radius can correspond to a substantially linear elongated body 102 without a curved section 120.

In some embodiments, the curved section 120 can extend outwardly from the outer surface of the linear section 118 of the elongated body 102 by a distance 124. In some embodiments, the distance 124 can be between approximately zero inches and approximately five inches. In some embodiments, the distance 124 can be approximately 3.125 inches. In some embodiments, the zero inch distance can correspond to a substantially linear elongated body 102 without a curved section 120. However, it should be understood that different dimensions could be used for the curved section 120 depending on the configuration of the toilet bowl and/or trap.

In some embodiments, the overall length 126 of the elongated body 102 can be dimensioned between approximately 18 inches and approximately 60 inches. In some embodiments, the overall length 126 of the elongated body 102 can be dimensioned as approximately 34.25 inches. In some embodiments, the overall length 126 of the elongated body 102 can be adjustable by incorporating, for example, a telescoping linear section 118 that can be adjusted or customized to accommodate users of different heights.

As noted above, introducing a hand-held drain cleaner or a cable associated with a drain cleaning gun into the toilet bowl can cause scarring or scratching of the surfaces of the plumbing fixture, thereby resulting in visible damage to the plumbing fixture. For example, certain cables of plumbing equipment can scar or scratch the porcelain of a toilet bowl while in use due to the constant rotation and movement of the cable as the cable is fed into the sanitary piping.

In order to reduce or prevent such damage, in some embodiments, the elongated body 102 can include one or more protective features 128, 130, disposed around and secured to portions of the elongated body 102. During use, when the curved section 120 is inserted into the bottom of the toilet bowl and the elongated body 102 is inclined to rest against the rim of the toilet bowl, the protective features 128, 130 can prevent or minimize damage (e.g., scarring) of the porcelain of the toilet. In some embodiments, the protective features 128, 130 can be fabricated from, e.g., foam, rubber, or the like, to provide padding during use of the plumbing device 100. In some embodiments, the protective feature 128 can be disposed over and covers the curved section 120 of the elongated body 102. In some embodiments, the protective feature 130 can be disposed over and covers a portion of the length of the linear section 118. For example, as shown in FIG. 1, the protective feature 130 can be disposed between the proximal end 106 and the distal end 116 of the linear section 118. During use, the linear section 118 of the elongated body 102 can be reclined against the inner perimeter of the toilet rim or edge and the protective feature 130 can prevent or minimize damage (e.g., scratching) of the porcelain of the toilet. In some embodiments, the protective feature 130 can be slidably disposed around the linear section 118 of the elongated body 102 such that the position of the protective feature 130 can be adjusted during use depending on the size and/or configuration of the toilet. In some embodiments, a single protective feature can be used that extends substantially the full length of the elongated body 102.

Figure 3:
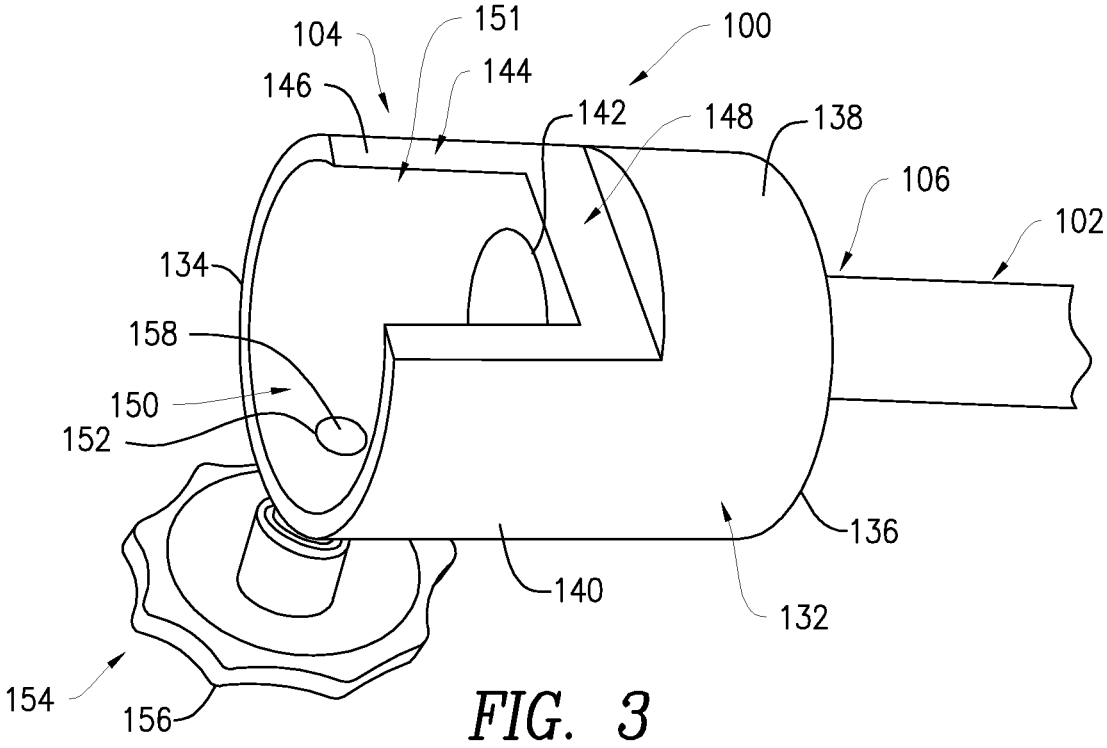
FIG. 3 is a top, perspective view of one embodiment of an adaptor of an exemplary plumbing device of FIG. 1.
Figure 4:
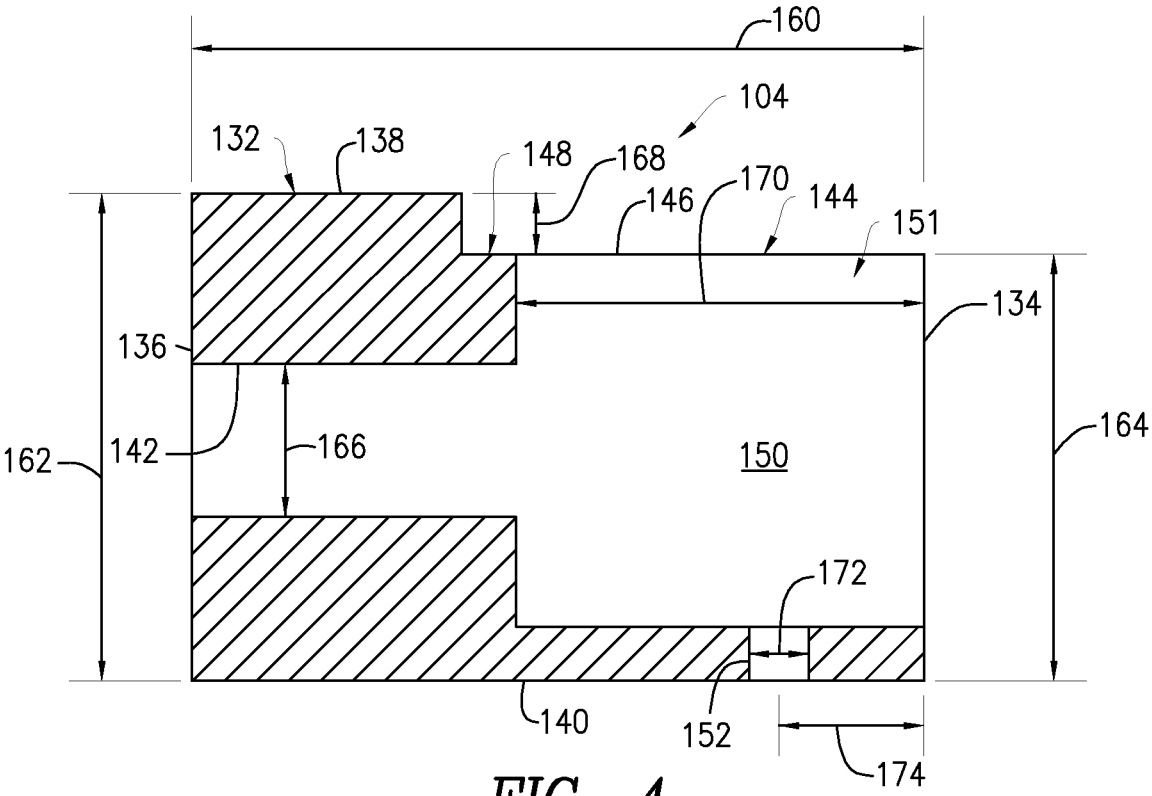
FIG. 4 is a diagrammatic, side cross-sectional view of one embodiment of an adaptor of FIG. 3.

With reference to FIGS. 3 and 4, top perspective and side cross-sectional views of one exemplary embodiment of an adaptor 104 are provided. However, it should be understood that alternative configurations of the adaptor 104 are contemplated. Feeding a cable of plumbing equipment through the elongated body 102 while the plumbing equipment is free to move relative to the elongated body 102 can result in insecure and unstable introduction of the cable into the elongated body 102, resulting in twisting of the cable near the proximal end 106 of the elongated body 102 and/or in the sanitary piping.

The hollow body of the adaptor 104 cooperates with one end of plumbing equipment and allows temporary or permanent fixation of the plumbing equipment to the elongated body 102. Securing the plumbing equipment to the elongated body 102 via the adaptor 104 fixates and stabilizes the position of the plumbing equipment relative to the elongated body 102, thereby stabilizing passage of the cable through the elongated body 102. In particular, fixation of the plumbing equipment to the elongated body 102 via the adaptor 104 prevents tangling of the cable near the proximal end 106 of the elongated body 102 resulting in a reduction or prevention of tangling of the cable in the sanitary piping. The lack of cable tangling due to the cooperation between the plumbing equipment, the adaptor 104 and the elongated body 102 therefore improves the efficiency of clearing a clog in sanitary piping.

In some embodiments, the adaptor 104 can be fabricated from aluminum. In some embodiments, the adaptor 104 can be fabricated from alternative metal and/or plastic materials. The adaptor 104 includes a substantially cylindrical body 132 including a proximal end 134 and a distal end 136. The body 132 further includes a first section 138 and a second section 140. The first section 138 can extend from the distal end 136 in the direction of the proximal end 134 and the second section 140 can extend from the proximal end 134 in the direction of the distal end 136 such that the first and second sections 138, 140 join between the proximal and distal ends 134, 136.

The first section 138 can define a substantially cylindrical and solid body with a bore 142 passing therethrough. The bore 142 can be configured and dimensioned for passage of the cable of plumbing equipment therethrough. In some embodiments, the inner surface of the bore 142 can include threads formed thereon complementary to threads at the proximal end 106 of the elongated body 102 such that at least a portion of the proximal end 106 of the elongated body 102 can be secured within the bore 142.

The second section 140 can define a partially cylindrical body extending on the bottom and sides of the second section 140, and includes a cut-out 144 at the top of the second section 140. The sides of the second section 140 can curve inwardly towards each other and be separated by an opening 151 formed along the edge of the cut-out 144. The cut-out 144 can form a substantially flat surface 146 extending from the proximal end 134 to a step 148 transition at the first section 138. The second section 140 further includes a cavity 150 formed therein. The hollow cavity 150 can extend from the first section 138 to the proximal end 134 and can connect to the bore 142. The cut-out 144 creates the opening 151 at the top of the second section 140, the opening 151 extending into the cavity 150. The flat surface 146 can extend beyond the opening 151 and up to the step 148 at the first section 138. In particular, the flat surface 146 can pass extending into the section of the body 132 in which the bore 142 is formed (see, e.g., FIG. 4). The second section 140 includes a bore 152 passing through a bottom portion of the second section 140. The bore 152 can be tapped, e.g., internally threaded, and configured and dimensioned to receive a portion of a fastening member 154 therein. The fastening member 154 can include a handle 156 and an externally threaded member 158 extending from the handle 156.

As will be discussed in greater detail below, the cavity 150 can be configured and dimensioned to receive therein a portion of one end of the plumbing equipment such that the cable associated with the plumbing equipment can be passed through the bore 142 and into the passage 110 of the elongated body 102. The threaded member 158 can be passed through the bore 152 and can be used as a set screw mechanism to detachably secure the plumbing equipment within the cavity 150. In particular, rather than allowing the plumbing equipment to freely move relative to the elongated body 102, the adaptor 104 can be used to secure the plumbing equipment to the elongated body 102, resulting in stable passage of the plumbing equipment cable through the elongated body 102 and into sanitary piping.

For example, the threaded member 158 can be engaged with the threads of the bore 152 and rotated to pass the threaded member 158 into the cavity 150 where the end of the plumbing equipment is situated. As the threaded member 158 is passed further into the cavity 150, one end of the threaded member 158 presses against and imparts a force on the plumbing equipment in the cavity 150 to push the plumbing equipment against the inner surface of the cavity 150. Due to frictional forces between the plumbing equipment and the inner surface of the cavity 150, as well as the continued force of the threaded member 158 on the plumbing equipment, removal of the plumbing equipment from the cavity 150 is prevented. In some embodiments, a bolt can be used instead of the fastening member 154 to secure the plumbing equipment in the cavity 150. The combination of the bore 152 and the fastening member 154 can thereby act as a locking or attachment mechanism for attaching plumbing equipment to the adaptor 104. The adaptor 104 therefore provides an interface through which plumbing equipment can be securely attached to the elongated body 102 to permit stable passage of cable through the elongated body 102 and into the sanitary piping.

In some embodiments, the overall length 160 of the adaptor 104 can be dimensioned between approximately 1½ inches and approximately 10 inches. In some embodiments, the overall length 160 of the adaptor 104 can be dimensioned as approximately 2.625 inches. In some embodiments, the height 162 of the first section 138 can be dimensioned between approximately 2 inches and approximately 6 inches. In some embodiments, the height 162 of the first section 138 can be dimensioned as approximately 2.75 inches, e.g., a 2.75 inch diameter. In some embodiments, the height 164 of the second section 140 can be dimensioned between approximately 1½ inches and approximately 5½ inches. In some embodiments, the height 164 of the second section 140 can be dimensioned as approximately 2.375 inches, e.g., a 2.375 inch diameter.

In some embodiments, the diameter 166 of the bore 142 can be dimensioned between approximately ⅝ inches and approximately 1⅞ inches. In some embodiments, the diameter 166 of the bore 142 can be dimensioned as approximately 0.937 inches. In some embodiments, the height 168 of the step 148 from the flat surface 146 to the top of the first section 138 can be dimensioned as between approximately zero inches and approximately ¾ inches. In some embodiments, the height 168 of the step 148 can be dimensioned as approximately 0.375 inches.

In some embodiments, the length 170 from the proximal end 134 to the bore 142 can be dimensioned between approximately one inch and approximately 8 inches. In some embodiments, the length 170 can be dimensioned as approximately 1.1875 inches. In some embodiments, the diameter 172 of the bore 152 can be dimensioned between approximately 5/32 inches and approximately ½ inches. In some embodiments, the diameter 172 of the bore 152 can be dimensioned as approximately 0.375 inches. In some embodiments, the distance 174 of the center of the bore 152 from the proximal end 134 can be any distance as long as the bore 152 is spaced at least ⅜ inches from the proximal end 134. In some embodiments, the distance 174 can be dimensioned as approximately 0.625 inches. Although positioned a distance 174 from the proximal end 134, it should be understood that the bore 152 can be any distance from the proximal end 134 to accommodate different types of plumbing equipment. In some embodiments, multiple bores 152 can be formed at different, spaced distances from the proximal end 134 to accommodate placement of the fastening member 154 at various positions depending on the type of plumbing equipment being used with the adaptor 104 (or the adaptor 200 discussed below). In some embodiments, the diameter of the cavity 150 can be dimensioned between approximately ⅜ inches and approximately 4½ inches. In some embodiments, the diameter of the cavity 150 can be dimensioned as approximately 2.33 inches.

Figure 5:
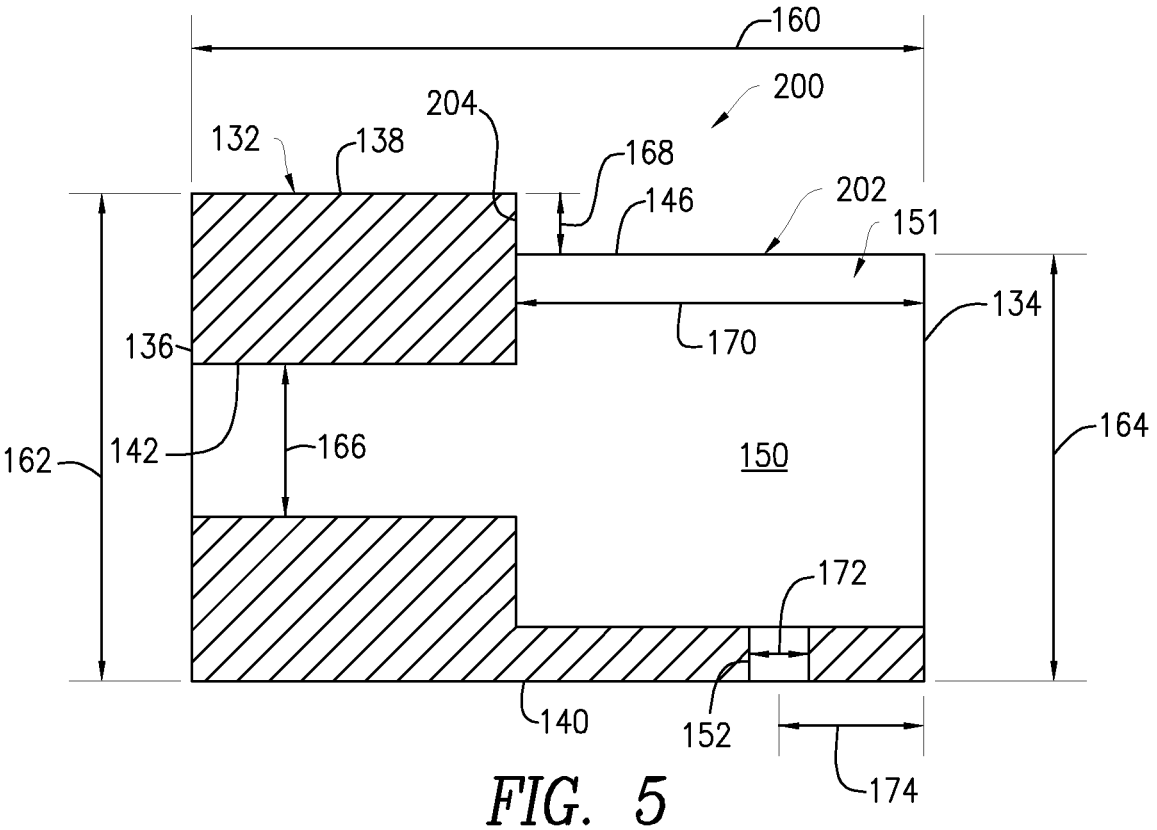
FIG. 5 is a diagrammatic, side cross-sectional view of one embodiment of an adaptor of an exemplary plumbing device.
Figure 6:
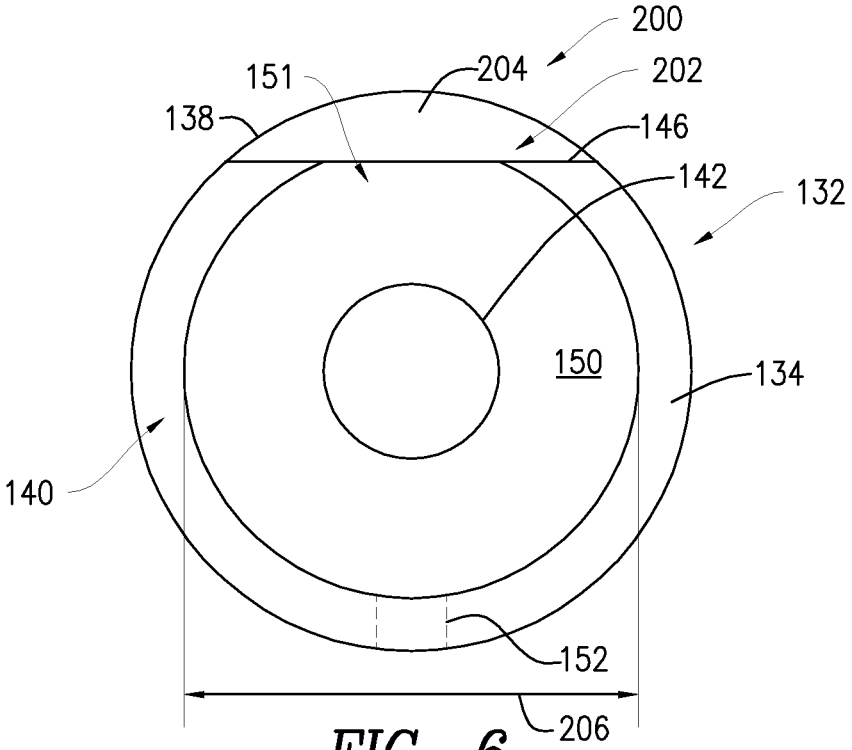
FIG. 6 is a diagrammatic, front view of one embodiment of an adaptor of FIG. 5.

With reference to FIGS. 5 and 6, a side cross-sectional view and a front view of another exemplary embodiment of an adaptor 200 are provided. However, it should be understood that alternative configurations of the adaptor 200 are contemplated. The adaptor 200 can be attached to the elongated body 102 of FIG. 1 in the same manner as adaptor 104. The adaptor 200 can be substantially similar in structure and function to the adaptor 104, except for the distinctions noted herein. As such, like reference numbers represent like structures. In particular, rather than including a cut-out 144 that forms a flat surface 146 extending beyond the opening 151 and up to a step 148 at the first section 138, the adaptor 200 includes a cut-out 202 that forms a flat surface 146 extending up to a proximal end 204 of the first section 138. Thus, the flat surface 146 does not extend into the section of the body 132 in which the bore 142 is formed (see, e.g., FIG. 5). The step 148 advantageously creates an opening or clearance area that allows the activation of a trigger of the plumbing equipment. In particular, the step 148 creates a space in which the trigger of certain plumbing equipment can move to feed and/or retract the cable. In some embodiments, the diameter 206 of the cavity 150 can be dimensioned between approximately one inch and approximately 4¾ inches. In some embodiments, the diameter 206 of the cavity 150 can be dimensioned as approximately 2.33 inches.

Figure 7:
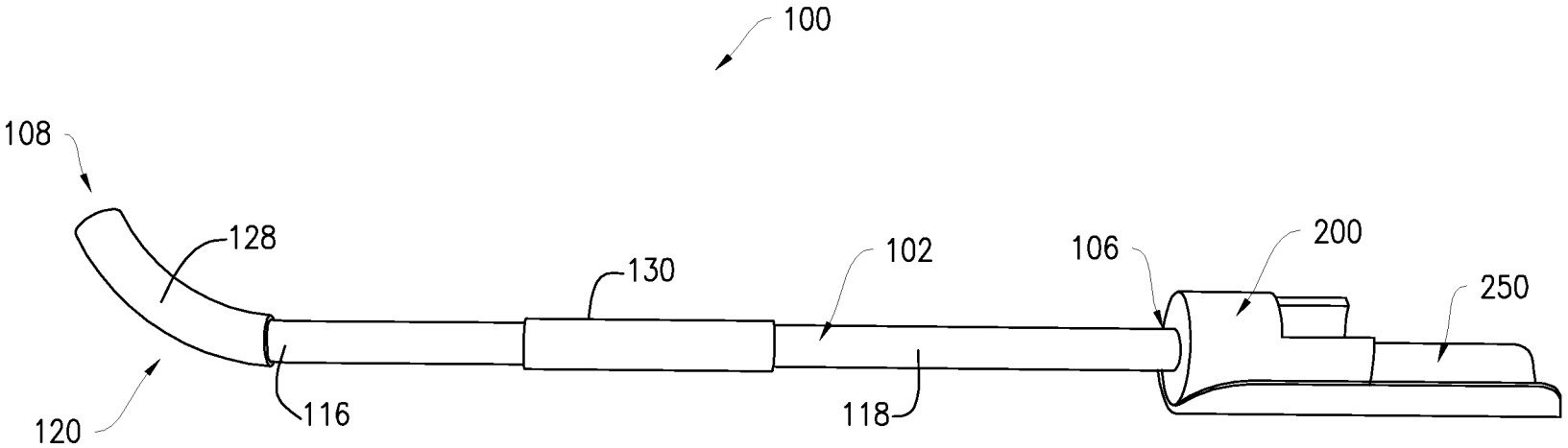
FIG. 7 is side view of an exemplary plumbing device including an elongated body, an adaptor, and a supporting cradle according to the present disclosure.

With reference to FIG. 7, the exemplary plumbing device 100 is shown. In particular, in addition to the elongated body 102 and the adaptor 200, in some embodiments, the plumbing device 100 can include an adjustable and self-supporting cradle 250. The supporting cradle 250 can be detachably secured to the adaptor 200 to provide a supporting surface for the plumbing equipment. In particular, the self-supporting cradle 250 can accommodate a variety of plumbing equipment types to allow the user to leave the plumbing equipment secured to the adaptor 200 in a hands-free manner. For example, during the process of unclogging sanitary piping, the user may need to check on other plumbing fixtures, make a telephone call, find a supervisor, or the like. Typically, such tasks require the user to remove the plumbing equipment from the plumbing fixture or place the plumbing equipment on the floor. The self-supporting cradle 250 allows the user to rest the plumbing equipment on the supporting cradle 250 and take care of additional tasks that may come up during the unclogging process. Although discussed herein as including the adaptor 200, it should be understood that the plumbing device 100 can also be used with the adaptor 104.

Figure 8:
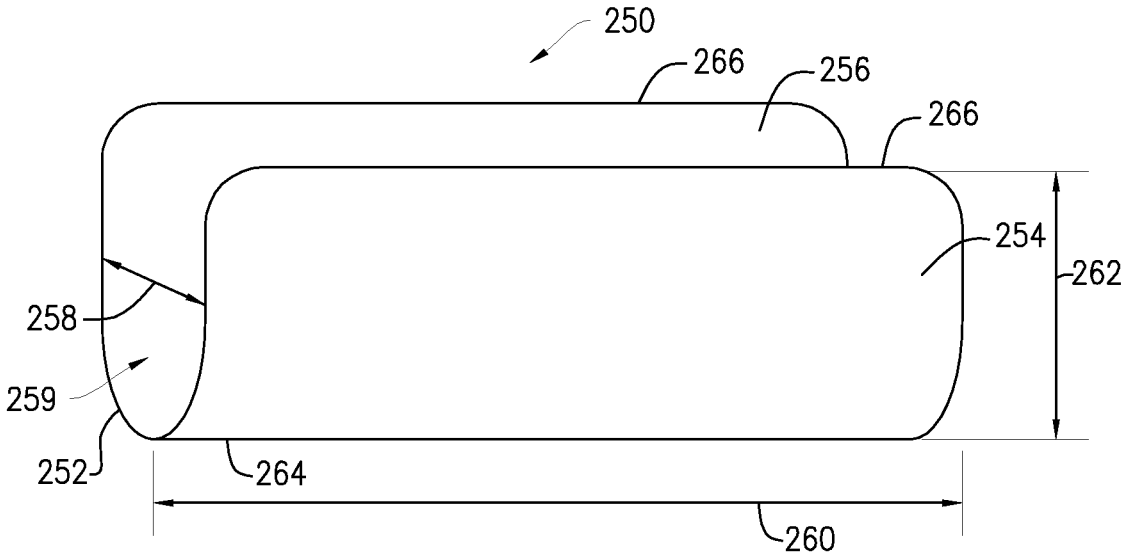
FIG. 8 is a diagrammatic, perspective view of a supporting cradle of an exemplary plumbing device of FIG. 7.
Figure 9:
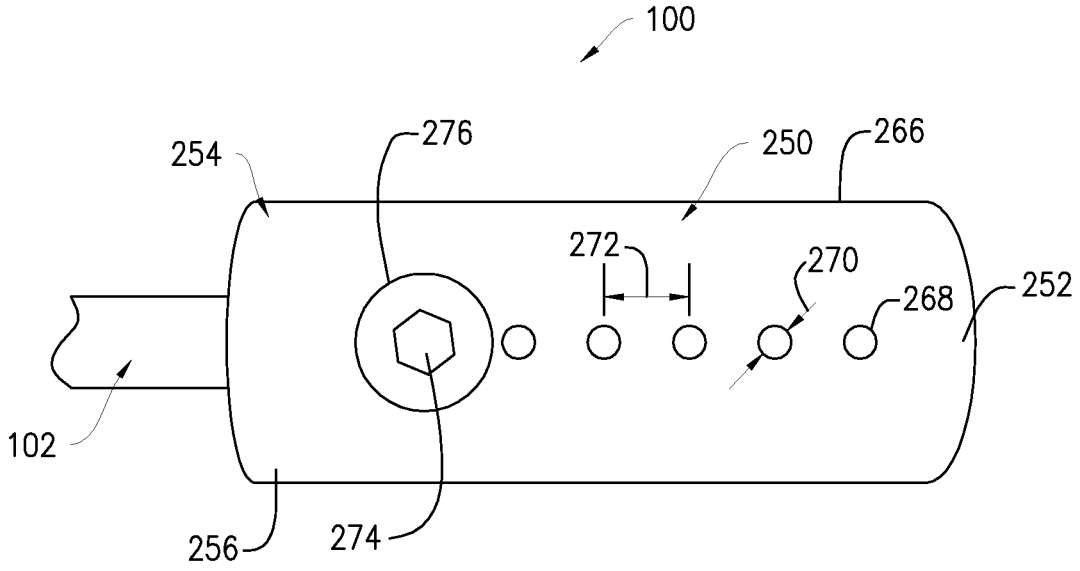
FIG. 9 is a bottom view of an assembly of an adaptor and a supporting cradle of an exemplary plumbing device of FIG. 7.

With reference to FIGS. 8 and 9, a diagrammatic view of one embodiment of an exemplary supporting cradle 250 and a bottom view of an assembly of the supporting cradle 250 with the adaptor 200 are provided. The supporting cradle 250 can accommodate and support any type of plumbing equipment secured to the adaptor 200. It should be understood that alternative configurations of the supporting cradle 250 are contemplated so long as the supporting cradle 250 is configured and dimensioned to provide support to plumbing equipment.

The supporting cradle 250 includes a curved central section 252 and two side sections 254, 256 extending from the curved central section 252. The curved central section 252 can define a diameter 258 that can be between approximately 2 inches and approximately 6 inches. In some embodiments, the diameter 258 can be dimensioned as approximately 2.75 inches. In particular, the diameter 258 of the curved central section 252 can be configured and dimensioned to be complementary to the diameter of the outer surface of the adaptor 200 such that the adaptor 200 can be positioned within the cavity 259 formed by the inner surface of the curved central section 252 and the two side sections 254, 256. The overall length 160 of the supporting cradle 250 can be dimensioned greater than the length 160 of the adaptor 200. In some embodiments, the length 160 can be dimensioned as between approximately 4 inches and approximately 9 inches. In some embodiments, the length 160 can be dimensioned as approximately 8.5 inches. A portion of the inner surface of the curved central section 252 can thereby receive the adaptor 200, while the remaining portion of the inner surface of the curved central section 252 can be used to support the plumbing equipment secured to the adaptor 200.

The two side sections 254, 256 can extend in a substantially parallel manner from the curved central section 252. The height 262 of the supporting cradle 250 can be measured from the bottom surface 264 of the curved central section 252 to the top surface 266 of the two side sections 254, 256. In some embodiments, the height 262 of the supporting cradle 250 can be dimensioned between approximately 1.625 inches and approximately two inches. For example, FIG. 8 shows the height 262 of the supporting cradle 250 as approximately two inches, while another supporting cradle 250 can have a height 262 of approximately 1.625 inches. Supporting cradles 250 having different heights 262 can be used based on the plumbing equipment being used with the plumbing device 100. For example, a supporting cradle 250 with a height 262 of 1.625 inches can be used for plumbing equipment having features that extend outward near the adaptor 200 and require additional room, while a supporting cradle 250 with a height 262 of two inches can be used for plumbing equipment having more compact features near the adaptor 200. A variety of dimensions associated with the supporting cradle 250 can be used depending on the dimensions of the adaptor 200 being used. In particular, the dimensions of the supporting cradle 250 can be sized to substantially match the dimensions of the adaptor 200 such that at least a portion of the adaptor 200 can be received by the supporting cradle 250.

The bottom surface 264 of the supporting cradle 250 can include one or more holes 268 formed therein. The holes 268 allow adjustability of the position of the supporting cradle 250 relative to the adaptor 200 based on the type of plumbing equipment being used with the plumbing device 100. In particular, the extension of the supporting cradle 250 relative to the adaptor 200 can be adjusted to provide greater or less support to plumbing equipment. For example, for plumbing equipment including a long barrel that attaches to the adaptor 200, a longer extension of the supporting cradle 250 can be used to provide adequate support to the barrel. As a further example, for plumbing equipment including a short barrel that attaches to the adaptor 200, a shorter extension of the supporting cradle 250 can be used to provide adequate support to the barrel while allowing sufficient space for other components of the plumbing equipment (e.g., the drum, trigger, or the like).

In some embodiments, the supporting cradle 250 can include, e.g., one hole, two holes, three holes, four holes, five holes, six holes, seven holes, eight holes, or the like. In some embodiments, each hole 268 can define a diameter 270 dimensioned to correspond to the diameter of the bore 152 of the adaptor 104/200. In some embodiments, the diameter 270 can be dimensioned between approximately 7/32 inches and approximately 5/8 inches. In some embodiments, the diameter 270 can be dimensioned as approximately 0.375 inches. In some embodiments, the center of each hole 268 can be spaced from the center of the next adjacent hole 268 by a distance 272 dimensioned between approximately 1/2 inches and approximately 1 1/4 inches. In some embodiments, the distance 272 can be dimensioned as approximately one inch.

The holes 268 can be configured and dimensioned to receive therethrough the threaded member 158 of the fastening member 154 (see, e.g., FIG. 3) and/or a bolt with threads complementary to the threads of the bore 152 of the adaptor 200. The supporting cradle 250 can thereby be positioned to partially surround the bottom surface of the adaptor 200, the desired hole 268 can be aligned with the bore 152 in the adaptor 200, and the fastening member 154 can be passed through the hole 268 and threaded into the bore 152 to secure the supporting cradle 250 to the adaptor 200. As noted above, the plurality of spaced holes 268 permit a customization of the assembly of the adaptor 200 and the supporting cradle 250 based on the size and/or configuration of the plumbing equipment being used with the plumbing device 100. In particular, based on the type of plumbing equipment being used, the extension of the supporting cradle 250 relative to the adaptor 200 can be adjusted to ensure sufficient support and space for the plumbing equipment.

Still with reference to FIG. 9, a bottom view of an assembly of the supporting cradle 250 with the adaptor 200 is provided. In particular, the adaptor 200 is positioned within the cavity 259 formed by the inner surface of the curved central section 252 and the two side sections 254, 256. The supporting cradle 250 can be oriented to align one of the holes 268 with the bore 152 formed in the bottom surface of the adaptor 200 and the fastening member 274 (e.g., a bolt) can be used to secure the supporting cradle 250 to the adaptor 200. It should be understood that the in addition to securing the supporting cradle 250 to the adaptor 200, the fastening member 274 can further be used to lock one end of the plumbing equipment within the cavity 150 of the adaptor 200 to prevent disengagement of the plumbing equipment relative to the adaptor 200. In some embodiments, a curved washer 276 defining a curvature complementary to the outer surface of the curved central section 252 of the supporting cradle 250 can be positioned between the fastening member 274 and the supporting cradle 250. In some embodiments, rather than using the fastening member 274 in the form of a bolt, a fastening member 154 including a handle 156 and a threaded member 158 can be used to secure the supporting cradle 250 to the adaptor 200 (see, e.g., FIG. 3).

Figure 10:
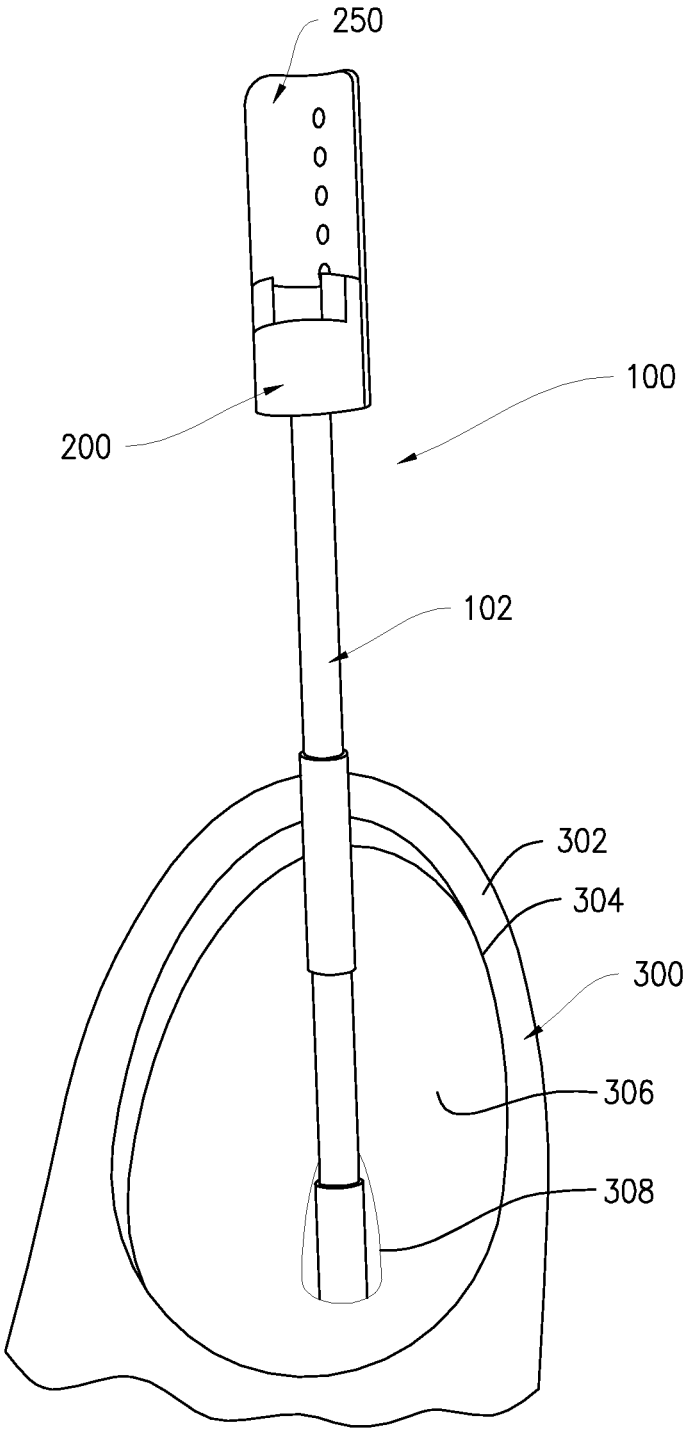
FIG. 10 is a top view of an exemplary plumbing device of FIG. 7 positioned within a plumbing fixture.

FIG. 10 shows a top view of the plumbing device 100 partially positioned within a plumbing fixture, i.e., a toilet 300. In particular, the adaptor 200 and the supporting cradle 250 are assembled relative to each other. The opening 151 at the top of the adaptor 200 and the cavity 150 face upwards for positioning of plumbing equipment therein. Further, the inner surface of the cavity 259 of the supporting cradle 250 faces upwards for supporting plumbing equipment thereon.

The toilet 300 includes a rim 302 defining an inner perimeter 304. The toilet 300 further includes an inner toilet bowl 306 and a passage 308 leading to the toilet trap and piping leading to a sewage line. During use, the curved section 120 of the elongated body 102 can be slid into and positioned within the passage 308 such that the protective feature 128 can be positioned against the porcelain of the passage 308 and/or the toilet bowl 306. The plumbing device 100 can be leaned downward to position the protective feature 130 against the rim 302 and/or inner perimeter 304 of the rim 302. The protective features 128, 130 thereby prevent or reduce damage (e.g., scratching, scarring, or the like) of the porcelain surfaces of the toilet 300. Leaning the elongated body 102 downward to position the protective feature 130 against the rim 302 can pivot the curved section 120 of the elongated body 102 in the passage 308 to direct the opening at the distal end 108 of the curved section 120 in the direction of the passage forming the toilet trap. Securing the plumbing equipment to the adaptor 200 ensures a stable passage of plumbing equipment cable into the elongated body 102 and through the sanitary piping. Passage of a cable associated with plumbing equipment through the hollow elongated body 102 and out of the opening at the distal end 108 of the elongated body 102 feeds the cable directly into passage forming the toilet trap. Directly feeding the cable into the toilet trap allows the cable to pass into the toilet trap weir and the associated piping in a substantially stable manner.

Figure 11:
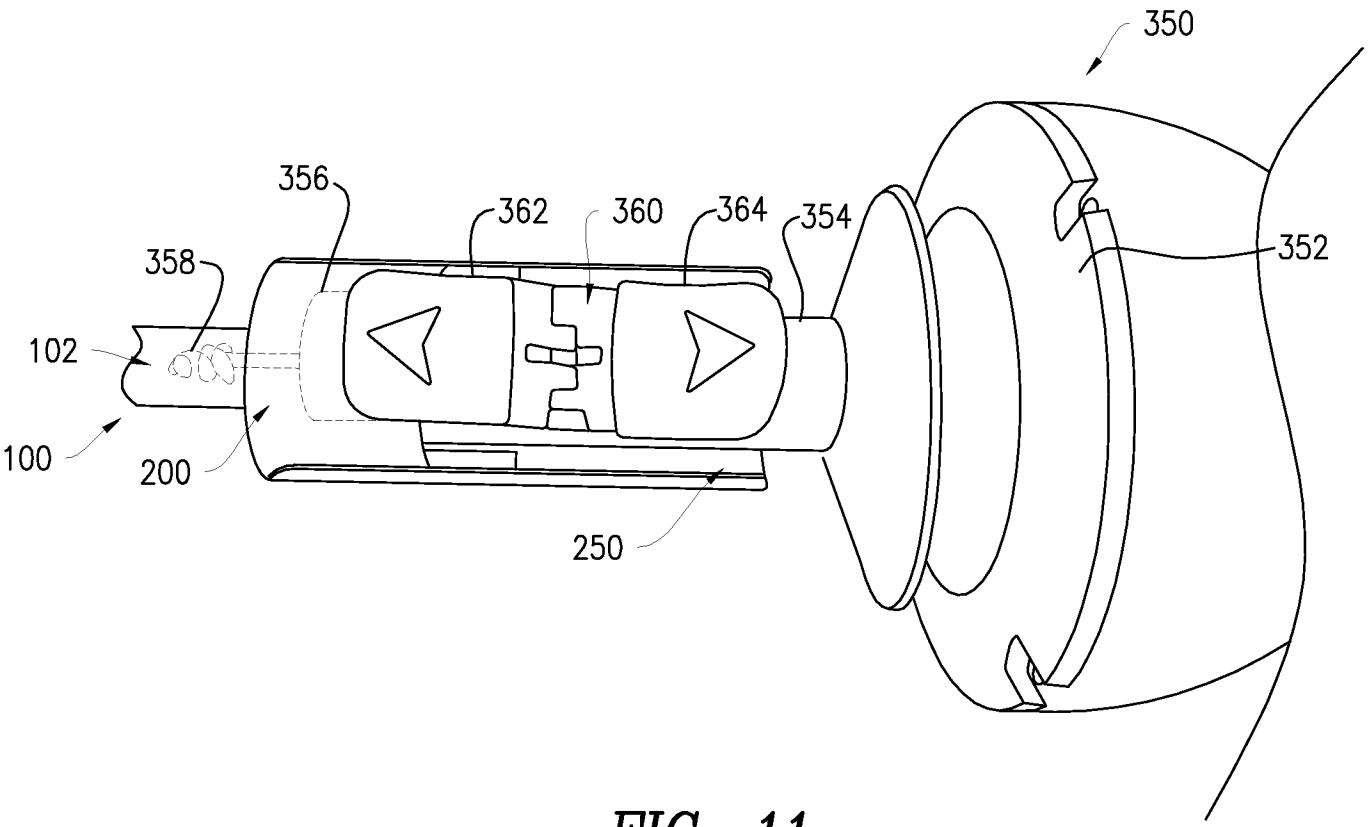
FIG. 11 a top view of an assembly of an exemplary plumbing device of FIG. 7 and plumbing equipment.

With reference to FIG. 11, a view of an assembly of the plumbing device 100 and plumbing equipment 350, e.g., an auto-feed drain cleaning gun, an auger, or the like, is provided. Although illustrated with specific plumbing equipment 350, it should be understood that a variety of plumbing equipment with similar configurations can be used in combination with the plumbing device 100. The plumbing equipment 350 generally includes a body 352 housing a spool of the cable 358 that can be extended out and retracted into the plumbing equipment 350. The plumbing equipment 350 includes a barrel 354 extending from the body 352 and defining a distal end 356. The barrel 354 can be formed to permit passage of the cable therethrough. In particular, the cable 358 can extend from the distal end 356 of the barrel 354 and can include, e.g., a coil, a blade, a bulk, or the like, for clearing the clog in the piping. In some embodiments, the plumbing equipment 350 can include a mechanism 360 for actuating feeding of the cable 358 out and into the body 352. For example, a first actuator 362 can be used to extend the cable 358 out of the body 352 and a second actuator 364 can be used to retract the cable 358 into the body 352.

The barrel 354 generally defines a substantially cylindrical surface. The cavity 150 of the adaptor 200 can be configured and dimensioned to receive therein at least the distal end 356 of the barrel 354. In particular, during assembly, the distal end of the cable 358 extending from the barrel 354 can be inserted into the bore 142 of the adaptor 200. The distal end 356 of the barrel 354 can further be inserted into the cavity 150 such that the curved bottom and sides of the second section 140 of the adaptor 200 house the distal end 356 of the barrel 354 therein. In particular, the opening 151 at the top of the second section 140 of the adaptor 200 can be dimensioned small enough to prevent passage of the distal end 356 of the barrel 354 (and the barrel 354) from the cavity 150 through the opening 151. The cut-out 144 can provide additional room for movement or actuation features of the plumbing equipment 350, such as the mechanism 360.

The position of the supporting cradle 250 relative to the adaptor 200 is adjusted to accommodate the length of the barrel 354 of the plumbing equipment 350. In particular, the supporting cradle 250 is extending from the adaptor 200 such that sufficient support is provided to the barrel 354, while space is provided for the body 352. The fastening member 374 can be used to secure the position of the supporting cradle 250 to the adaptor 200.

After positioning of the distal end 356 of the barrel 354 within the cavity 150, the fastening member 374 can further be used in a manner similar to a set screw to secure the distal end 356 of the barrel 354 within the cavity 150 of the adaptor 200. Specifically, the fastening member 374 can be threaded into the bore 152 of the adaptor 200 until the distal end of the fastening member 374 forces the barrel 354 against the inner top surface of the cavity 150. The force of the barrel 354 against the inner top surface of the cavity 150 creates a friction force that prevents withdrawal of the barrel 354 from the cavity 150. It should be understood that the fastening member 374 can be loosened to permit withdrawal of the barrel 354 from the cavity 150 after use. Although illustrated as being assembled on a surface, such as a floor, it should be understood that the plumbing device 100 and the plumbing equipment 350 can be assembled while the curved section 120 of the plumbing device 100 is disposed within the passage 308 of the toilet 300.

Still with reference to FIG. 11, the barrel 354 of the plumbing equipment 350 extends from the adaptor 200 and is disposed at least partially within the cavity 259 of the supporting cradle 250. The bottom surface 264 and the two side sections 254, 256 can provide stable and self-supporting surfaces against which the barrel 354 can be positioned. For example, the bottom surface 264 can provide support for the weight of the barrel 354 (and the plumbing equipment 350) and the two side sections 254, 256 can provide support to the sides of the barrel 354 to prevent movement of the barrel 354 relative to the adaptor 200. Once the plumbing equipment 350 has been assembled relative to the adaptor 200, the mechanism 360 can be used to feed the cable 358 in and out of the toiled trap weir and associated sanitary piping.

Figure 12:
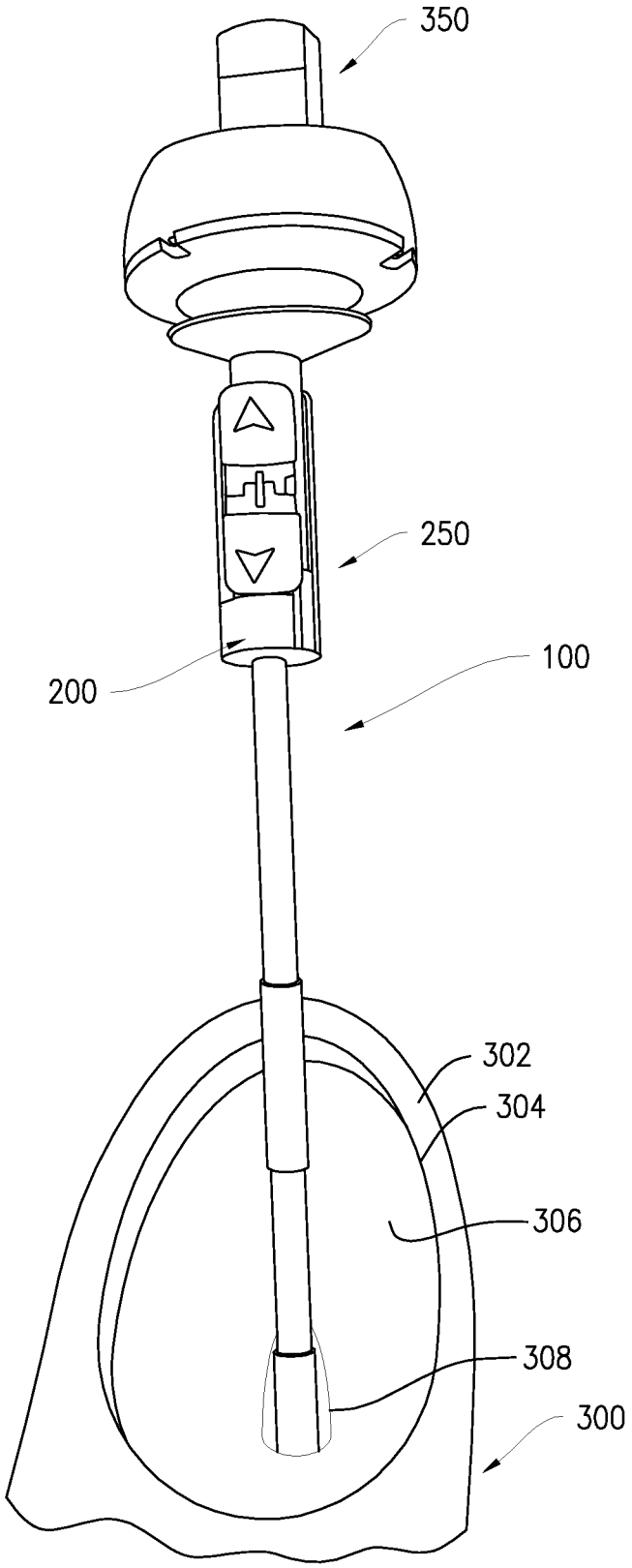
FIG. 12 is a top view of an assembly of an exemplary plumbing device of FIG. 7 and plumbing equipment, the exemplary plumbing device positioned within a plumbing fixture.

With reference to FIG. 12, a top view of an assembly of the plumbing device 100 and the plumbing equipment 350 positioned within the toilet 300 is provided. In particular, the curved section 120 of the elongated body 102 is positioned within the passage 308 of the toilet 300 and the elongated body 102 is positioned to rest or lean against the rim 302 of the toilet 300. As noted above, pivoting of the curved section 120 of the elongated body 102 such that the elongated body 102 is positioned against the rim 302 directs the opening at the distal end 108 of the curved section 120 in the direction of the passage formed by the trap of the toilet 300.

FIG. 12 further shows the self-supporting capability of the supporting cradle 250. In particular, the supporting cradle 250 can provide support to at least a portion of the plumbing equipment 350, e.g., the barrel 254, such that constant support to the plumbing equipment 350 does not need to be provided by the user. For example, if a user is cleaning the piping with the plumbing equipment 350 and the plumbing device 100, the user can stop operation and walk away from the toilet 300 without disassembling the plumbing equipment 350 from the plumbing device 100. In particular, the curved section 120 of the elongated body 102 hooked within the passage 308, the elongated body 102 positioned or leaning against the rim 302 of the toilet 300, and the supporting cradle 250 can distribute and support the weight of the plumbing equipment 350 while the user is away from the toilet 300.

The ability to leave the plumbing equipment 350 assembled to the plumbing device 100 and leave the toilet 300 during interruptions without providing support to the plumbing equipment 350 provides efficiency and convenience during the process of clearing a clog in piping. In some embodiments, the supporting cradle 250 can be used to balance and support the plumbing equipment 350 while maintaining the hands of the user free to attend to other tasks without removing the plumbing equipment 350 and/or the plumbing device 100. Leaving the plumbing device 100 and the plumbing equipment 350 in an assembled manner in the toilet 300 can further assist in reducing spillage caused by constant water displacement from removal of the plumbing equipment 350 from the toilet 300.

Figure 13:
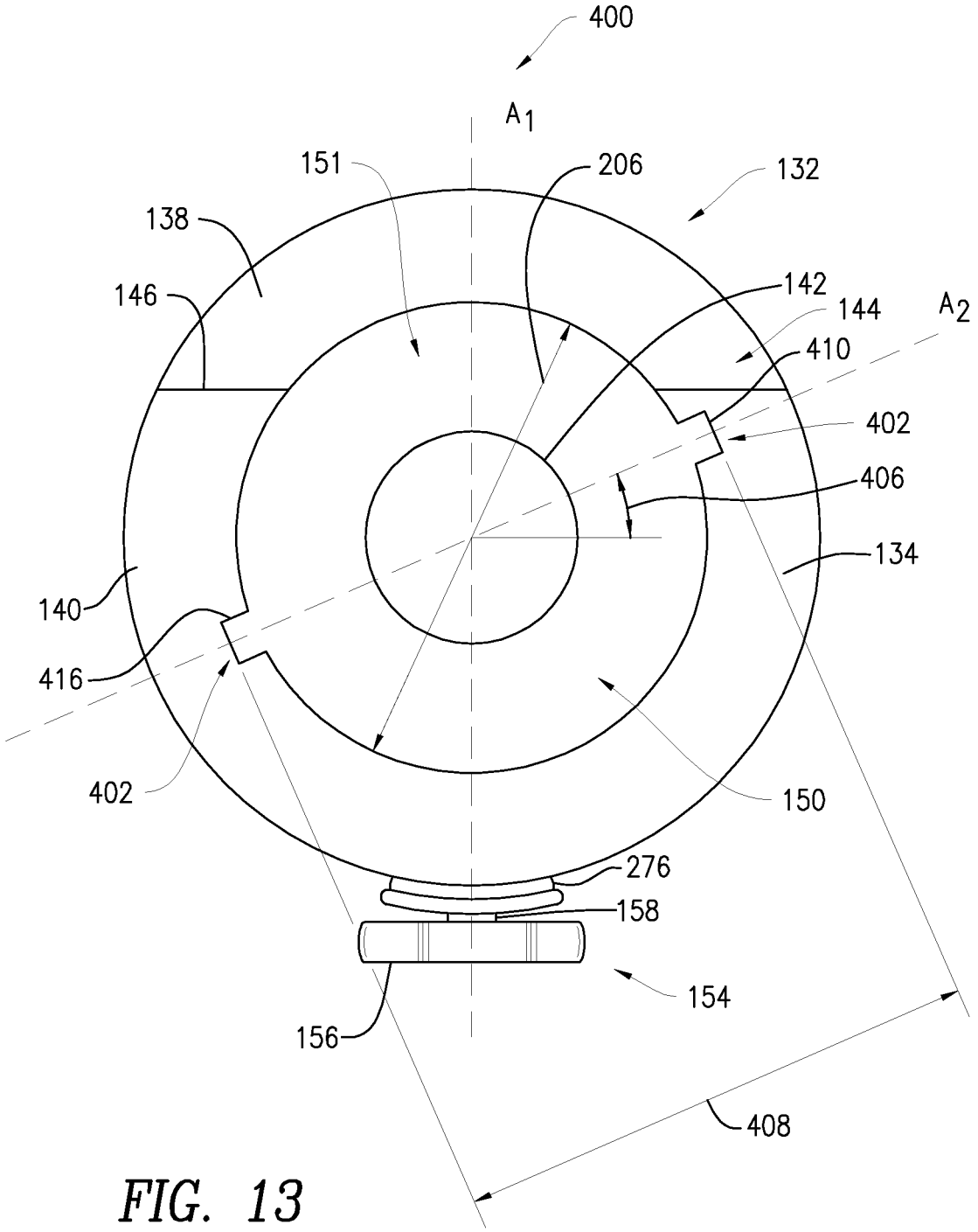
FIG. 13 is a rear view of an exemplary adaptor according to the present disclosure.
Figure 14:
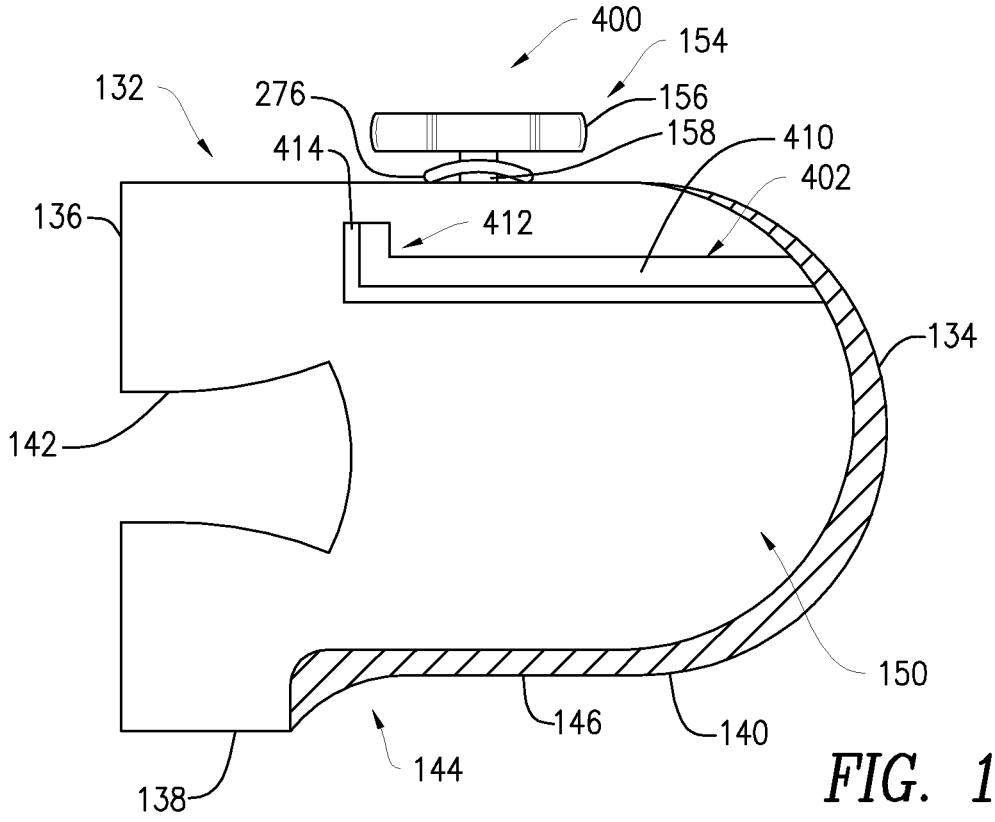
FIG. 14 is a right side, cross-sectional view of an exemplary adaptor of FIG. 13.
Figure 15:
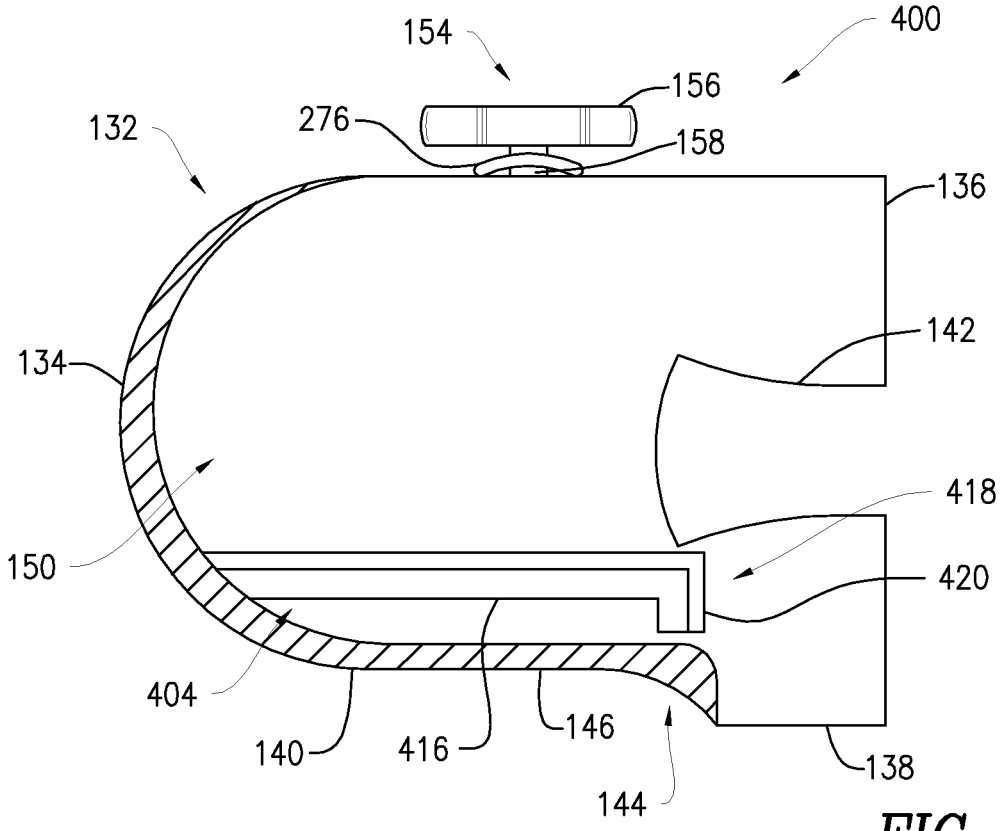
FIG. 15 is a left side, cross-sectional view of an exemplary adaptor of FIG. 13.

With reference to FIGS. 13-15, rear and cross-sectional views of an alternative embodiment of an adaptor 400 are provided. The adaptor 400 can be substantially similar in structure and function to the adaptor 104, except for the distinctions noted herein. Therefore, like reference numbers represent like structures. As will be discussed in greater detail below, rather than using the supporting cradle 250 to support plumbing equipment, the adaptor 400 can be used without a supporting cradle 250 to interlock or engage with the plumbing equipment such that the adaptor 400 itself supports the plumbing equipment.

In particular, the second section 140 of the adaptor 400 includes a first slot 402 and a second slot 404 formed in the second section 140. The first and second slots 402, 404 can be radially disposed relative to the cavity 150 on opposing sides of the second section 140. The fastening member 154 can be aligned with the first and second sections 138, 140 along a first vertical axis $A_1$. In some embodiments, the first and second slots 402, 404 can be formed along a second axis $A_2$. The second axis $A_2$ can be offset from an axis transverse to the first vertical axis $A_1$ by an angle 406. Due to the formation of the first and second slots 402, 404 in the inner surfaces of the cavity 150 of the second section 140, the diameter 408 as measured between the first and second slots 402, 404 is dimensioned greater than the diameter 206 of the cavity 150 by the depth of the first and second slots 402, 404.

The first slot 402 can extend a partial length of the second section 140 from the proximal end 134 in the direction of the distal end 136 of the adaptor 400. The first slot 402 includes an elongated portion 410 extending from the proximal end 134. At a distal end 412 of the elongated portion 410, the first slot 402 includes a downwardly curved groove 414. The groove 414 can extend substantially perpendicularly relative to the elongated portion 410 while following the rounded curvature of the second section 140. The length of the groove 414 can be substantially smaller than the length of the elongated portion 410.

The second slot 404 can extend a partial length of the second section 140 from the proximal end 134 in the direction of the distal end 136 of the adaptor 400. The second slot 404 also includes an elongated portion 416 extending from the proximal end 134. However, at a distal end 418 of the elongated portion 416, the second slot 404 includes an upwardly curved groove 420. The groove 420 can extend substantially perpendicularly relative to the elongated portion 416 while following the rounded curvature of the second section 140. The length of the groove 420 can be substantially smaller than the length of the elongated portion 416. Thus, the first and second grooves 414, 420 extend in opposing directions. It should be understood that the groove 414 can extend in an upward direction and the groove 420 can extend in a downward direction, so long as the grooves 414, 420 extend in opposing directions.

Figure 16:
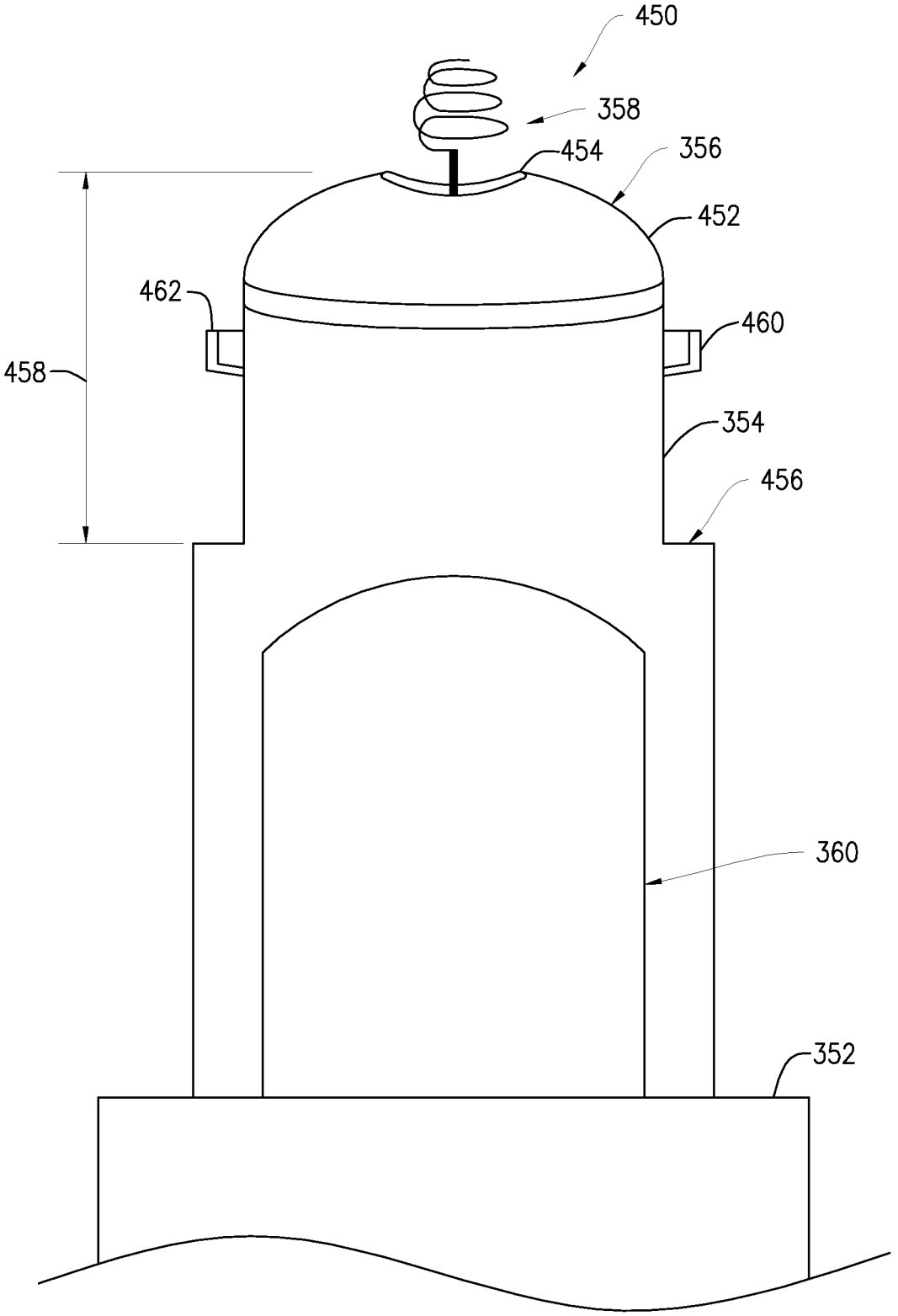
FIG. 16 is a top view of exemplary plumbing equipment configured to interlock with an exemplary adaptor of FIG. 13 according to the present disclosure.

FIG. 16 is a top view of exemplary plumbing equipment 450 configured to interlock or engage with the adaptor 400 such that the adaptor 400 supports the plumbing equipment 450 without the use of a supporting cradle 250. The plumbing equipment 450 can be substantially similar in structure and function to the plumbing equipment 350, except for the distinctions noted herein. Therefore, like reference numbers represent like structures.

The plumbing equipment 450 includes a body 352 housing a spool of cable 358 that can be extended out and retracted into the plumbing equipment 450. The plumbing equipment 450 includes a barrel 354 extending from the body 352 and defining a distal end 356. In some embodiments, distal end 356 can be in the form of a half-circle cap 452 including a central opening 454 configured and dimensioned for passage of the cable 358. In some embodiments, the barrel 354 can include a radial step 456 spaced from the distal end 356. In some embodiments, the distance 458 of the radial step 456 from the distal end 356 of the plumbing equipment 450 can be substantially similar to the length 170 of the cavity 150 such that the distal end 356 and a portion of the barrel 354 prior to the step 456 can be inserted into the cavity 150 (see, e.g., FIG. 4).

The barrel 354 includes first and second protrusions 460, 462 extending radially from the barrel 354. The first and second protrusions 460, 462 can be spaced from the distal end 356 and positioned between the distal end 356 and the radial step 456. The first and second protrusions 460, 462 can be configured and dimensioned complementary to the first and second slots 402, 404 of the adaptor 400 such that the first protrusion 460 can be inserted into and slid along the first slot 402 and the second protrusion 462 can be inserted and slid along the second slot 404. In particular, the first and second protrusions 460, 462 can be aligned with the first and second slots 402, 404, and the barrel 354 can be inserted into the cavity 150 while sliding the first and second protrusions 460, 462 into the first and second slots 402, 404. Due to the offset formation of the first and second slots 402, 404, alignment of the first and second protrusions 460, 462 with the first and second slots 402, 404 generally entails rotating the plumbing equipment 450 counterclockwise from a centered position.

When the first and second protrusions 460, 462 reach the distal ends 412, 418 of the elongated portions 410, 416, the plumbing equipment 450 and the barrel 354 can be twisted in, e.g., a clockwise direction, to slide into and engage the first and second protrusions 460, 462 with the respective grooves 414, 420. Engagement of the first and second protrusions 460, 462 with the respective grooves 414, 420 interlocks the barrel 354 with the adaptor 400 such that the plumbing equipment 450 cannot be disengaged from the adaptor 400 until the plumbing equipment 450 is rotated in, e.g., a counterclockwise direction, to disengage the first and second protrusions 460, 462 from the grooves 414, 420. Interlocking of the plumbing equipment 450 with the adaptor 400 provide support to the plumbing equipment 450 with the adaptor 400 itself, allowing the user to leave the plumbing equipment 450 unattended without removing the plumbing equipment 450 from the adaptor 400.

The exemplary plumbing devices discussed herein thereby provide for an efficient and convenient process of cleaning clogged piping. In one embodiment, the adaptor and adjustable position of the supporting cradle can be used to customize the plumbing device for a variety of plumbing equipment having different configurations. In another embodiment, the exemplary adaptor can engage or interlock with plumbing equipment such that the adaptor supports the plumbing equipment without the use of the supporting cradle. The plumbing devices provide the ability to use standard plumbing equipment in commercial settings including long sanitary piping in an efficient manner. Clogs in sanitary piping can be cleared with plumbing equipment in combination with the plumbing devices without the removal of cleanout plugs and/or the plumbing fixture, thereby reducing the amount of time necessary to clear the clog. The plumbing devices are lightweight, can be handled by a single user and allow for hands-free use, thereby reducing the costs associated with using larger plumbing equipment. In addition, the plumbing devices advantageously prevent or reduce the occurrence of damage to the toilet bowl surfaces. The plumbing devices thereby accommodate safe and stable extension of cable associated with plumbing equipment through the toilet trap and piping to clear clogs.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A plumbing device, comprising: an elongated body, the elongated body defining a proximal end and a distal end; and an adaptor disposed at or mounted to the proximal end of the elongated body, the adaptor including: (i) a first section extending from a distal end of the adaptor to an inner step within the adaptor, the distal end of the adaptor defining a first outer edge of the adaptor, (ii) a second section extending from a proximal end of the adaptor to the inner step within the adaptor, the proximal end of the adaptor defining a second outer edge of the adaptor opposing the first outer edge of the adaptor, the first section and the second section joined to each other at the inner step within the adaptor. (iii) a bore formed in the first section of the adaptor and extending from the distal end of the adaptor to the inner step within the adaptor, and (iv) a cavity formed in the second section of the adaptor and extending from the proximal end of the adaptor to the inner step within the adaptor, a diameter of the bore is dimensioned smaller than a diameter of the cavity, the difference in the diameters of the bore and the cavity and a connection between the bore and the cavity forming the inner step within the adaptor; wherein the bore is configured and dimensioned to couple with the proximal end of the elongated body and the cavity of the adaptor is configured and dimensioned to detachably receive therein at least a portion of plumbing equipment; and wherein the first section of the adaptor includes a body, and the second section of the adaptor includes a bottom, sides, and a cut-out forming a flat top surface of the second section.

2. The plumbing device of claim 1, wherein the elongated body comprises a hollow tube including a linear section and a curved section, the curved section being disposed at the distal end of the elongated body.

3. The plumbing device of claim 2, comprising a first protective feature disposed around a portion of the linear section and a second protective feature disposed around the curved section.

4. The plumbing device of claim 1, wherein the adaptor comprises a locking mechanism, the locking mechanism detachably securing the portion of plumbing equipment within the cavity of the adaptor.

5. The plumbing device of claim 4, wherein the locking mechanism comprises (i) a threaded bore formed in a bottom surface of the second section of the adaptor and extending into the cavity, and (ii) a threaded fastening member configured to mate with the threaded bore and pass into the cavity to impart a force on the portion of plumbing equipment, the force imparted on the portion of plumbing equipment preventing removal of the portion of plumbing equipment from the cavity.

6. The plumbing device of claim 1, wherein the adaptor comprises an opening formed between side walls of the flat top surface, the opening extending into the cavity.

7. The plumbing device of claim 1, comprising a supporting cradle detachably secured to the adaptor, the supporting cradle including a curved central section and two side sections extending from the curved central section.

8. The plumbing device of claim 7, wherein a diameter of the curved central section is uniform, and the curved central section defines a uniform height along a length of the supporting cradle between opposing sides of the supporting cradle.

9. The plumbing device of claim 7, wherein the two side sections extend parallel to each other from the curved central section.

10. The plumbing device of claim 7, wherein a bottom surface of the curved central section includes holes extending therethrough and into a cavity formed by the curved central section and the two side sections, the holes aligned and spaced along a length of the bottom surface of the curved central section.

11. The plumbing device of claim 1, wherein the second section comprises two radially disposed slots formed on inner walls of the second section, each of the slots being configured and dimensioned to receive and interlock with complementary protrusions of the plumbing equipment.

12. The plumbing device of claim 11, wherein each of the slots includes an elongated portion extending from a proximal end of the adaptor and a perpendicular groove extending from a distal end of the elongated portion.

13. The plumbing device of claim 1, wherein the diameter of the bore is uniform between the distal end of the adaptor and the inner step within the adaptor, and the diameter of the cavity is uniform between the proximal end of the adaptor and the inner step within the adaptor.

14. A method of plumbing repair, comprising: providing a plumbing device, the plumbing device including (i) an elongated body, the elongated body defining a proximal end and a distal end, and (ii) an adaptor disposed at or mounted to the proximal end of the elongated body, the adaptor including: (a) a first section extending from a distal end of the adaptor to an inner step within the adaptor, the distal end of the adaptor defining a first outer edge of the adaptor, (b) a second section extending from a proximal end of the adaptor to the inner step within the adaptor, the proximal end of the adaptor defining a second outer edge of the adaptor opposing the first outer edge of the adaptor, the first section and the second section joined to each other at the inner step within the adaptor, (c) a bore formed in the first section of the adaptor and extending from the distal end of the adaptor to the inner step within the adaptor, and (d) a cavity formed in the second section of the adaptor and extending from the proximal end of the adaptor to the inner step within the adaptor, a diameter of the bore is dimensioned smaller than a diameter of the cavity, the difference in the diameters of the bore and the cavity and a connection between the bore and the cavity forming the inner step within the adaptor; wherein the first section of the adaptor includes a body, and the second section of the adaptor includes a bottom, sides, and a cut-out forming a flat top surface of the second section; coupling the bore with the proximal end of the elongated body; positioning the distal end of the elongated body within a passage of a plumbing fixture; detachably receiving at least a portion of pluming equipment within the cavity of the adaptor; and securing the portion of plumbing equipment within the cavity of the adaptor.

15. The method of claim 14, comprising detachably securing the portion of plumbing equipment within the cavity of the adaptor with a locking mechanism, the locking mechanism comprising a threaded fastening member passing through a threaded bore formed in a bottom surface of the adaptor and imparting a force on the portion of plumbing equipment.

16. The method of claim 14, comprising detachably securing a supporting cradle to the adaptor and supporting the plumbing equipment with the supporting cradle without support of the plumbing equipment from a user.

17. The method of claim 14, comprising interlocking protrusions extending from a distal end of the plumbing equipment with slots formed in the adaptor to detachably secure the plumbing equipment to the adaptor.

18. A plumbing device system, comprising: a plumbing device, the plumbing device including (i) an elongated body, the elongated body defining a proximal end and a distal end, and (ii) an adaptor disposed at or mounted to the proximal end of the elongated body, the adaptor including: (a) a first section extending from a distal end of the adaptor to an inner step within the adaptor, the distal end of the adaptor defining a first outer edge of the adaptor, (b) a second section extending from a proximal end of the adaptor to the inner step within the adaptor, the proximal end of the adaptor defining a second outer edge of the adaptor opposing the first outer edge of the adaptor, the first section and the second section joined to each other at the inner step within the adaptor, (c) a bore formed in the first section of the adaptor and extending from the distal end of the adaptor to the inner step within the adaptor, and (d) a cavity formed in the second section of the adaptor and extending from the proximal end of the adaptor to the inner step within the adaptor, a diameter of the bore is dimensioned smaller than a diameter of the cavity, the difference in the diameters of the bore and the cavity and a connection between the bore and the cavity forming the inner step within the adaptor, wherein the first section of the adaptor includes a cylindrical body, and the second section of the adaptor includes a bottom, sides, and a cut-out forming a flat top surface of the second section; and plumbing equipment; wherein the bore of the adaptor is configured and dimensioned to couple within the proximal end of the elongated body and the cavity of the adaptor is configured and dimensioned to detachably receive therein at least a portion of the plumbing equipment.

19. The plumbing device system of claim 18, wherein: the second section including two radially disposed slots formed on inner walls of the second section; the plumbing equipment comprises a barrel including two radially disposed protrusions complementary to the two radially disposed slots of the adaptor; and each of the two radially disposed slots is configured and dimensioned to receive and interlock with the two radially disposed protrusions of the plumbing equipment to detachably secure the plumbing equipment to the adaptor.

* * * * *